US010553223B2

(12) United States Patent
Fatus et al.

(10) Patent No.: US 10,553,223 B2
(45) Date of Patent: Feb. 4, 2020

(54) ADAPTIVE CHANNEL-REDUCTION PROCESSING FOR ENCODING A MULTI-CHANNEL AUDIO SIGNAL

(71) Applicant: ORANGE, Paris (FR)

(72) Inventors: Bertrand Fatus, Le Chesnay (FR); Stephane Ragot, Lannion (FR)

(73) Assignee: ORANGE, Paris (FR)

( * ) Notice: Subject to any disclaimer, the term of this patent is extended or adjusted under 35 U.S.C. 154(b) by 0 days.

(21) Appl. No.: 16/063,090

(22) PCT Filed: Dec. 13, 2016

(86) PCT No.: PCT/FR2016/053353
§ 371 (c)(1),
(2) Date: Jun. 15, 2018

(87) PCT Pub. No.: WO2017/103418
PCT Pub. Date: Jun. 22, 2017

(65) Prior Publication Data

US 2019/0156841 A1 May 23, 2019

(30) Foreign Application Priority Data

Dec. 16, 2015 (FR) ..... 15 62485

(51) Int. Cl.
*G10L 19/008* (2013.01)

(52) U.S. Cl.
CPC ..... *G10L 19/008* (2013.01)

(58) Field of Classification Search
CPC ..... G10L 19/008
USPC ..... 381/22, 23
See application file for complete search history.

(56) References Cited

FOREIGN PATENT DOCUMENTS

| | | |
|---|---|---|
| EP | 2722845 A1 | 4/2014 |
| WO | 2010105926 A2 | 9/2010 |

OTHER PUBLICATIONS

International Search Report dated Feb. 9, 2017, for corresponding International Application No. PCT/FR2016/053353, filed Dec. 13, 2016.
Written Opinion dated Feb. 9, 2017, for corresponding International Application No. PCT/FR2016/053353, filed Dec. 13, 2016.
(Continued)

*Primary Examiner* — David L Ton
(74) *Attorney, Agent, or Firm* — David D. Brush; Westman, Champlin & Koehler, P.A.

(57) ABSTRACT

A method for parametric encoding of a multi-channel digital audio signal. The method includes encoding a mono signal from channel-reduction processing applied to the multi-channel signal and encoding spatialisation information of the multi-channel signal. The channel-reduction processing includes the following steps, implemented for each spectral unit of the multi-channel signal: extracting at least one indicator characterizing the channels of the multi-channel digital audio signal; selecting, from a set of channel-reduction processing modes, a channel-reduction processing mode in accordance with the value of the at least one indicator characterizing the channels of the multi-channel audio signal. Also provides are a corresponding encoding device and a processing method which includes the channel-reduction processing.

9 Claims, 14 Drawing Sheets

(56) References Cited

OTHER PUBLICATIONS

English translation of the Written Opinion dated Feb. 9, 2017, for corresponding International Application No. PCT/FR2016/053353, filed Dec. 13, 2016.
Junghoe Kim et al. "Enhanced Stereo Coding with phase parameters for MPEG Unified Speech and Audio Coding." Jan. 1, 2009.
J. Breebaart et al. "Parametric Coding of Stereo Audio." EURASIP Journal of Applied Signal Processing 2005: 9, pp. 1305-1322. 2005.
Samsudin et al. "A Stereo to Mono Downmixing Scheme for MPEG-4 Parametric Stereo Encoder." Proc. ICASSP, 2006.
T.M.N. Hoang et al. "Parametric stereo extension of ITU-T G.722 based on a new downmixing scheme." Proc. IEEE MMSP, Oct. 4-6, 2010.
Wu et al. "Parametric Stereo Coding Scheme with a New Downmix Method and Whole Band Inter Channel Time/Phase Differences." Proc. ICASSP. 2013.

ADAPTIVE CHANNEL-REDUCTION PROCESSING FOR ENCODING A MULTI-CHANNEL AUDIO SIGNAL

CROSS-REFERENCE TO RELATED APPLICATIONS

This Application is a Section 371 National Stage Application of International Application No. PCT/FR2016/053353, filed Dec. 13, 2018, the content of which is incorporated herein by reference in its entirety, and published as WO 2017/103418 on Jun. 22, 2017, not in English.

FIELD OF THE DISCLOSURE

The present invention relates to the field of the coding/decoding of digital signals.

The coding and the decoding according to the invention is suitable in particular for the transmission and/or the storage of digital signals such as audio frequency signals (speech, music or the like).

More particularly, the present invention relates to the parametric coding or to the multi-channel audio signal processing, for example of stereophonic signals, hereinafter called stereo signals.

This type of coding is based on the extraction of spatial information parameters so that, on decoding, these spatial characteristics can be reconstructed for the listener, in order to recreate the same spatial image as in the original signal.

BACKGROUND OF THE DISCLOSURE

Such a parametric coding/decoding technique is for example described in the document by J. Breebaart, S. van de Par, A. Kohlrausch, E. Schuijers, entitled "Parametric Coding of Stereo Audio" in EURASIP Journal on Applied Signal Processing 2005:9, pp. 1305-1322. This example is taken up with reference to FIGS. 1 and 2 respectively describing a parametric stereo coder and decoder.

Thus, FIG. 1 describes a stereo coder receiving two audio channels, a left channel (denoted L) and a right channel (denoted R).

The temporal signals L(n) and R(n), where n is the integer index of the samples, are processed by the blocks 101, 102, 103 and 104 which perform a short-term Fourier analysis. The transformed signals L[k] and R[k], where k is the integer index of the frequency coefficients, are thus obtained.

The block 105 performs a downmix processing to obtain, in the frequency domain from the left and right signals, a monophonic signal, hereinafter called mono signal.

An extraction of spatial information parameters is also performed in the block 105. The extracted parameters are as follows.

The ICLD (for "InterChannel Level Difference") parameters, also called interchannel intensity differences, characterize the energy ratios per frequency sub-band between the left and right channels. These parameters make it possible to position sound sources in the stereo horizontal plane by "panning". They are defined in dB by the following formula:

$$ICLD[b] = 10 \cdot \log_{10}\left\{\frac{\sum_{k=k_b}^{k_{b+1}-1} L[k] \cdot L^*[k]}{\sum_{k=k_b}^{k_{b+1}-1} R[k] \cdot R^*[k]}\right\}\text{dB} \quad (1)$$

where L[k] and R[k] correspond to the (complex) spectral coefficients of the L and R channels, each frequency band of index b comprises the frequency lines in the interval $[k_b, k_b+1-1]$ and the * symbol indicates the complex conjugate.

The ICPD ("InterChannel Phase Difference") parameters, also called phase differences, are defined according to the following relationship:

$$\text{ICPD}[b]=\angle(\Sigma_{k=k_b}^{k_{b+1}-1} L[k].R^*[k]) \quad (2)$$

where ∠ indicates the argument (the phase) of the complex operand.

It is also possible to define, in a way equivalent to the ICPD, an interchannel time difference called ICTD and the definition of which known to the person skilled in the art is not recalled here.

Unlike the ICLD, ICPD and ICTD parameters which are localization parameters, the ICC ("InterChannel Coherence") parameters for their part represent the inter-channel correlation (or coherence) and are associated with the spatial width of the sound sources; the definition thereof is not recalled here, but it is noted in the article by Breebart et al. that the ICC parameters are not necessary in the sub-bands reduced to a single frequency coefficient—in effect, the amplitude and phase differences fully describe the spatialization in this "degenerated" case.

These ICLD, ICPD and ICC parameters are extracted by analysis of the stereo signals, by the block 105. If the ICTD or ITD parameters were also coded, the latter could also be extracted for each sub-band from the spectra L[k] and R[k]; however, the extraction of the ITD parameters is generally simplified by assuming an identical inter-channel time difference for each sub-band and in this case a parameter can be extracted from the time channels L(n) and R(n) through inter-correlations.

The mono signal M[k] is transformed into the time domain (blocks 106 to 108) after short-term Fourier synthesis (inverse FFT, windowing and addition-overlap called Overlap-Add or OLA) and a mono coding (block 109) is then performed. In parallel, the stereo parameters are quantized and coded in the block 110.

Generally, the spectrum of the signals (L[k], R[k]) is divided according to a nonlinear frequency scale of ERB (Equivalent Rectangular Bandwidth) or Bark type, with a number of sub-bands typically ranging from 20 to 34 for a sampled signal of 16 to 48 kHz according to the Bark scale. This scale defines the values of $k_b$ and $k_{b+1}$ for each sub-band b. The parameters (ICLD, ICPD, ICC, ITD) are coded by scalar quantization possibly followed by an entropic coding and/or a differential coding. For example, in the abovementioned article, the ICLD is coded by a non-uniform quantizer (ranging from −50 to +50 dB) with differential entropic coding. The non-uniform quantization step exploits the fact that the auditory sensitivity to the variations of this parameter becomes increasingly weaker as the ICLD value increases.

For the coding of the mono signal (block 109), several quantization techniques with or without memory are possible, for example the "Pulse Code Modulation" (PCM) coding, its version with adaptive prediction called "Adaptive Differential Pulse Code Modulation" (ADPCM) or more advanced techniques such as the perceptual coding by transform or the "Code Excited Linear Prediction" (CELP) coding or a multi-mode coding.

The interest here is more particularly focused on the 3GPP EVS ("Enhanced Voice Services") recommendation which uses a multi-mode coding. The algorithmic details of the EVS codec are provided in the 3GPP specifications TS 26.441 to 26.451 and they are not therefore repeated here. Hereinbelow, reference will be made to these specifications by the reference EVS.

The input signal of the EVS codec is sampled at the frequency of 8, 16, 32 or 48 kHz and the codec can represent telephone audio bands (narrowband, NB), wideband (WB), super-wideband (SWB) or full band (FB). The bit rates of the EVS codec are divided into two modes:

"EVS Primary":

- set bit rates: 7.2, 8, 9.6, 13.2, 16.4, 24.4, 32, 48, 64, 96, 128
- variable bit rate mode (VBR) with an average bit rate close to 5.9 kbit/s for active speech
- "channel-aware" mode at 13.2 in WB and SWB only "EVS AMR-WB IO" for which the bit rates are identical to the 3GPP AMR-WB codec (9 modes).

To that is added the discontinuous transmission mode (DTX) in which the frames detected as inactive are replaced by SID (SID Primary or SID AMR-WB IO) frames which are transmitted intermittently, approximately once every 8 frames.

On the decoder 200, referring to FIG. 2, the mono signal is decoded (block 201), a decorrelator is used (block 202) to produce two versions $\hat{M}(n)$ and $\hat{M}'(n)$ of the decoded mono signal. This decorrelation, necessary only when the ICC parameter is used, makes it possible to augment the spatial width of the mono source $\hat{M}(n)$. These two signals $\hat{M}(n)$ and $\hat{M}'(n)$ are switched into the frequency domain (blocks 203 to 206) and the decoded stereo parameters (block 207) are used by the stereo synthesis (or formatting) (block 208) to reconstruct the left and right channels in the frequency domain. These channels are finally reconstructed in the time domain (blocks 209 to 214).

Thus, as mentioned for the coder, the block 105 performs a downmix or downmix processing by combining the stereo channels (left, right) to obtain a mono signal which is then coded by a mono coder. The spatial parameters (ICLD, ICPD, ICC, etc.) are extracted from the stereo channels and transmitted in addition to the bit stream from the mono coder.

Several techniques have been developed for the stereo to mono downmix processing. This downmix can be performed in the time or frequency domain. Two types of downmix are generally distinguished:

- the passive downmix which corresponds to a direct matrixing of the stereo channels to combine them into a single signal—the coefficients of the downmix matrix are generally real and of predetermined (set) values;
- the active (adaptive) downmix which includes a control of the energy and/or of the phase in addition to the combining of the two stereo channels.

The simplest example of passive downmix is given by the following time matrixing:

$$M(n) = \frac{1}{2}(L(n) + R(n)) = \begin{bmatrix} 1/2 & 0 \\ 0 & 1/2 \end{bmatrix} \begin{bmatrix} L(n) \\ R(n) \end{bmatrix} \tag{3}$$

This type of downmix does however have the drawback of not conserving the energy of the signals well after the stereo to mono conversion when the L and R channels are not in phase: in the extreme case where L(n)=−R(n), the mono signal is nil, which is not desirable.

An active downmix mechanism improving the situation is given by the following equation:

$$M(n) = \gamma(n)\frac{L(n) + R(n)}{2} \tag{4}$$

where γ(n) is a factor which compensates any energy loss.

However, the combining of the signals L(n) and R(n) in the time domain does not make it possible to control any phase differences between the L and R channels finely (with sufficient frequency resolution); when the L and R channels have comparable amplitudes and almost opposite phases, phenomena of "erasure" or "attenuation" (loss of "energy") on the mono signal can be observed by frequency sub-bands in relation to the stereo channels.

This is why it is often more advantageous in quality terms to perform the downmix in the frequency domain, even if that involves computing time/frequency transforms and induces additional delay and complexity compared to a time downmix.

It is thus possible to transpose the preceding active downmix with the spectra of the left and right channels, as follows:

$$M[k] = \gamma[k]\frac{L[k] + R[k]}{2} \tag{5}$$

where k corresponds to the index of a frequency coefficient (Fourier coefficient for example representing a frequency sub-band). The compensation parameter can be set, as follows:

$$\gamma[k] = \max\left(2, \sqrt{\frac{|L[k]|^2 + |R[k]|^2}{|L[k] + R[k]|^2/2}}\right) \tag{6}$$

There is thus an assurance that the overall energy of the downmix is the sum of the energies of the left and right channels. The factor y[k] is here saturated at an amplification of 6 dB.

The stereo to mono downmix technique of the document by Breebaart et al. cited previously is performed in the frequency domain. The mono signal M[k] is obtained by a linear combining of the L and R channels according to the equation:

$$M[k]=w_1L[k]+w_2R[k] \tag{7}$$

where $w_1$, $w_2$ are complex value gains. If $w_1=w_2=0.5$, the mono signal is considered to be an average of the two L and R channels. The gains $w_1$,$w_2$ are generally adapted according to the short-term signal in particular to align the phases.

A particular case of this frequency downmix technique is proposed in the document entitled "A stereo to mono downmixing scheme for MPEG-4 parametric stereo encoder" by Samsudin, E. Kurniawati, N. Boon Poh, F. Sattar, S. George, in Proc. ICASSP, 2006. In this document, the L and R channels are aligned in phase before performing the downmix processing.

More specifically, the phase of the L channel for each frequency sub-band is chosen as the reference phase, the R channel is aligned according to the phase of the L channel for each sub-band by the following formula:

$$R'[k]=e^{j\cdot ICPD[b]}R[k] \tag{8}$$

where $j=\sqrt{-1}$,R'[k] is the aligned R channel, k is the index of a coefficient in the $b^{th}$ frequency sub-band, ICPD[b] is the inter-channel phase difference in the $b^{th}$ frequency sub-band given by the equation (1). Note that when the sub-band of index b is reduced to a frequency coefficient, the following applies:

$$R'[k]=|R[k]|.e^{j\angle L[k]} \tag{9}$$

Finally, the mono signal obtained by the downmix of the document by Samsudin et al. cited previously is computed by averaging the L channel and the aligned R' channel, according to the following equation:

$$M[k] = \frac{L[k] + R'[k]}{2} \tag{10}$$

The phase alignment therefore makes it possible to conserve the energy and to avoid the problems of attenuation by eliminating the influence of the phase. This downmix corresponds to the downmix described in the document by Breebart et al., where:

$$M[k]=w_1L[k]+w_2R[k] \tag{11}$$

with $w_1$=0.5 and $$w_2 = \frac{e^{j\cdot ICPD[b]}}{2}$$

in the case where the sub-band of index b comprises only one frequency value of index k.

An ideal conversion of a stereo signal to a mono signal should avoid the problems of attenuation for all the frequency components of the signal.

This downmix operation is important for the parametric stereo coding because the decoded stereo signal is only a spatial formatting of the decoded mono signal.

The downmix technique in the frequency domain described previously does conserve the energy level of the stereo signal well in the mono signal by aligning the R channel and the L channel before performing the processing. This phase alignment makes it possible to avoid the situations where the channels are in phase opposition.

The method described in the document by Samsudin referenced above however relies on a total dependency of the downmix processing on the channel (L or R) chosen to set the reference phase.

In the extreme cases, if the reference channel is nil ("total" silence) and the other channel is non-nil, the phase of the mono signal after downmix becomes constant, and the resulting mono signal will generally be of poor quality; similarly, if the reference channel is a random signal (ambient noise, etc.), the phase of the mono signal can become random or be ill-conditioned with, here again, a mono signal which will generally be of poor quality.

An alternative frequency downmix technique has been proposed in the document entitled "Parametric stereo extension of ITU-T G.722 based on a new downmixing scheme" by T. M. N Hoang, S. Ragot, B. Kovesi, P. Scalart, Proc. IEEE MMSP, 4-6 Oct. 2010. This document proposes a downmix technique which resolves the drawbacks of the downmix proposed by Samsudin et al. According to this document, the mono signal M[k] is computed from the stereo channels L[k] and R[k] by the polar decomposition $M[k]=|M[k]|.e^{j\angle M[k]}$, where the amplitude |M[k]| and the phase ∠M[k] for each sub-band are defined by:

$$\begin{cases} |M[k]| = \dfrac{|L[k]| + |R[k]|}{2} \\ \angle M[k] = (\angle L[k] + \angle R[k]) \end{cases} \tag{12}$$

The amplitude of M[k] is the average of the amplitudes of the L and R channels. The phase of M[k] is given by the phase of the signal summing the two stereo channels (L+R).

The method of Hoang et al. preserves the energy of the mono signal like the method of Samsudin et al., and it avoids the problem of total dependency of one of the stereo channels (L or R) for the phase computation ∠M[k]. However, it presents a disadvantage when the L and R channels are in virtual phase opposition in certain sub-bands (with, as extreme case L=−R). In these conditions, the resulting mono signal will be of poor quality.

In the ITU-T G.722 annex D codec and in the article "Parametric stereo coding scheme with a new downmix method and whole band inter channel time/phase differences" by W. Wu, L. Miao, Y. Lang, D. Virette, Proc. ICASSP. 2013, another method making it possible to manage the phase opposition of the stereo signals has been described. The method relies in particular on the estimation of a full band phase parameter. It is possible to check experimentally that the quality of this method is unsatisfactory for stereo signals where the phase relationship between channels is complex or for stereo speech signals with sound pick-up of AB type (using two omnidirectional microphones spaced apart). In effect, this method consists in computing the phase of the downmix signal from the phases of the L and R signals, and this computation can result in audio artifacts for certain signals because the phase defined by short-term FFT analysis is a parameter that is difficult to interpret and manipulate.

Furthermore, this method does not directly take account of the phase changes which can occur in successive frames which can possibly bring about phase jumps.

There is thus a need for a coding/decoding method of limited complexity which makes it possible to combine channels with a "robust" quality, that is to say a good quality regardless of the type of multi-channel signal, while managing the signals in phase opposition, the signals whose phase is ill-conditioned (e.g.: a nil channel or a channel containing only noise), or the signals for which the channels exhibit complex phase relationships that it would be better not to "manipulate", to avoid the quality problems that these signals can create.

SUMMARY

The invention improves the prior art situation.

To this end, it proposes a method for parametric coding of a multi-channel digital audio signal comprising a step of coding a mono signal derived from a downmix processing applied to the multi-channel signal and of coding multi-channel signal spatialization information. The method is noteworthy in that the downmix processing comprises the following steps, implemented for each spectral unit of the multi-channel signal:

- extraction of at least one indicator characterizing the channels of the multi-channel digital audio signal;
- selection, from a set of downmix processing modes, of a downmix processing mode as a function of the value of the at least one indicator characterizing the channels of the multi-channel audio signal.

Thus, the method makes it possible to obtain a downmix processing suited to the multi-channel signal to be coded, in particular when the channels of this signal are in phase opposition. Furthermore, since the adaptation of the downmix is performed for each frequency unit, that is to say for each frequency sub-band or for each frequency line, that makes it possible to adapt to the fluctuations of the multi-channel signal from one frame to another.

According to a particular embodiment, the method also comprises the determination of a phase indicator, representative of a measurement of degree of phase opposition between the channels of the multi-channel signal and in that one of the downmix processing modes of said set depends on the value of the phase indicator.

A particular downmix processing is thus performed for the signals whose channels are in phase opposition. This processing is implemented in a way that is adapted to the fluctuation of the signal over time.

In an exemplary embodiment, the set of downmix processing modes comprises a plurality of processing from the following list:

- passive-type downmix processing with or without gain compensation;
- adaptive-type downmix processing with alignment of the phase on a reference and/or energy control;
- hybrid-type downmix processing dependent on a phase indicator, representative of a measurement of degree of phase opposition between the channels of the multi-channel signal;
- combination of at least two passive, adaptive or hybrid processing modes.

Several types of downmix processing are thus possible for a better adaptation to the multi-channel signal.

In a particular embodiment, the indicator characterizing the channels of the multi-channel audio signal is an indicator of measurement of correlation between the channels of the multi-channel audio signal.

This indicator makes it possible to adapt the downmix processing to the correlation characteristics of the channels of the multi-channel audio signal. The determination of this indicator is simple to implement and the downmix quality is thereby enhanced.

In another embodiment, the indicator characterizing the channels of the multi-channel audio signal is a phase indicator, representative of a measurement of degree of phase opposition between the channels of the multi-channel signal.

This indicator makes it possible to adapt the downmix processing to the phase characteristics of the channels of the multi-channel audio signal and in particular to the signals which have channels in phase opposition.

The invention relates to a device for parametric coding of a multi-channel digital audio signal comprising a coder capable of coding a mono signal derived from a downmix processing module applied to the multi-channel signal and a quantization module for coding multi-channel signal spatialization information. The device is noteworthy in that the downmix processing module comprises:

- an extraction module capable of obtaining at least one indicator characterizing the channels of the multi-channel digital audio signal, for each spectral unit of the multi-channel signal;
- a selection module, capable of selecting, for each spectral unit of the multi-channel signal, from a set of downmix processing modes, a downmix processing mode as a function of the value of the at least one indicator characterizing the channels of the multi-channel audio signal.

This device offers the same advantage as the method that it implements.

The invention applies also to a method for processing a decoded multi-channel audio signal comprising a downmix processing to obtain a mono signal to be reproduced. The method is noteworthy in that the downmix processing comprises the following steps, implemented for each spectral unit of the multi-channel signal:

- extraction of at least one indicator characterizing the channels of the multi-channel digital audio signal;
- selection, from a set of downmix processing modes, of a downmix processing mode as a function of the value of the at least one indicator characterizing the channels of the multi-channel audio signal.

Thus, it is possible to obtain a mono signal with a good auditory quality, from a multi-channel audio signal that is already decoded. The method makes it possible to perform a downmix processing adapted to the received signal, in a simple way.

According to a particular embodiment, the processing method also comprises the determination of a phase indicator, representative of a measurement of degree of phase opposition between the channels of the multi-channel signal and in that one of the downmix processing modes of said set depends on the value of the phase indicator.

A particular downmix processing is thus performed for the decoded signals whose channels are in phase opposition. This processing is implemented in a way adapted to the fluctuation of the signal over time.

In an exemplary embodiment, the set of downmix processing modes comprises a plurality of processing from the following list:

- passive-type downmix processing with or without gain compensation;
- adaptive-type downmix processing with alignment of the phase on a reference and/or energy control;
- hybrid-type downmix processing dependent on a phase indicator, representative of a measurement of degree of phase opposition between the channels of the multi-channel signal;
- combination of at least two passive, adaptive or hybrid processing modes.

Several types of downmix processing are thus possible for a better adaptation to the multi-channel signal.

In a particular embodiment, the indicator characterizing the channels of the multi-channel audio signal is an indicator of measurement of correlation between the channels of the multi-channel audio signal.

This indicator makes it possible to adapt the downmix processing to the correlation characteristics of the channels of the decoded multi-channel audio signal. The determination of this indicator is simple to implement and the quality of the downmix is thereby enhanced.

In another embodiment, the indicator characterizing the channels of the multi-channel audio signal is a phase indicator, representative of a measurement of degree of phase opposition between the channels of the multi-channel signal.

This indicator makes it possible to adapt the downmix processing to the phase characteristics of the channels of the multi-channel audio signal and in particular to the signals which have channels in phase opposition.

The invention relates also to a device for processing a decoded multi-channel audio signal comprising a downmix processing module for obtaining a mono signal to be reproduced, noteworthy in that the downmix processing module comprises:

an extraction module capable of obtaining at least one indicator characterizing the channels of the multi-channel digital audio signal, for each spectral unit of the multi-channel signal;

a selection module, capable of selecting, for each spectral unit of the multi-channel signal, from a set of downmix processing modes, a downmix processing mode as a function of the value of the at least one indicator characterizing the channels of the multi-channel audio signal.

This device offers the same advantages as the method described above that it implements.

Finally, the invention relates to a computer program comprising code instructions for implementing the steps of a coding method according to the invention, when these instructions are executed by a processor.

The invention relates finally to a processor-readable storage medium on which is stored a computer program comprising code instructions for the execution of the steps of the method as described.

BRIEF DESCRIPTION OF THE DRAWINGS

Other features and advantages of the invention will become more clearly apparent on reading the following description, given purely as a non-limiting example, and with reference to the attached drawings, in which.

DETAILED DESCRIPTION OF ILLUSTRATIVE EMBODIMENTS

Figure 1:
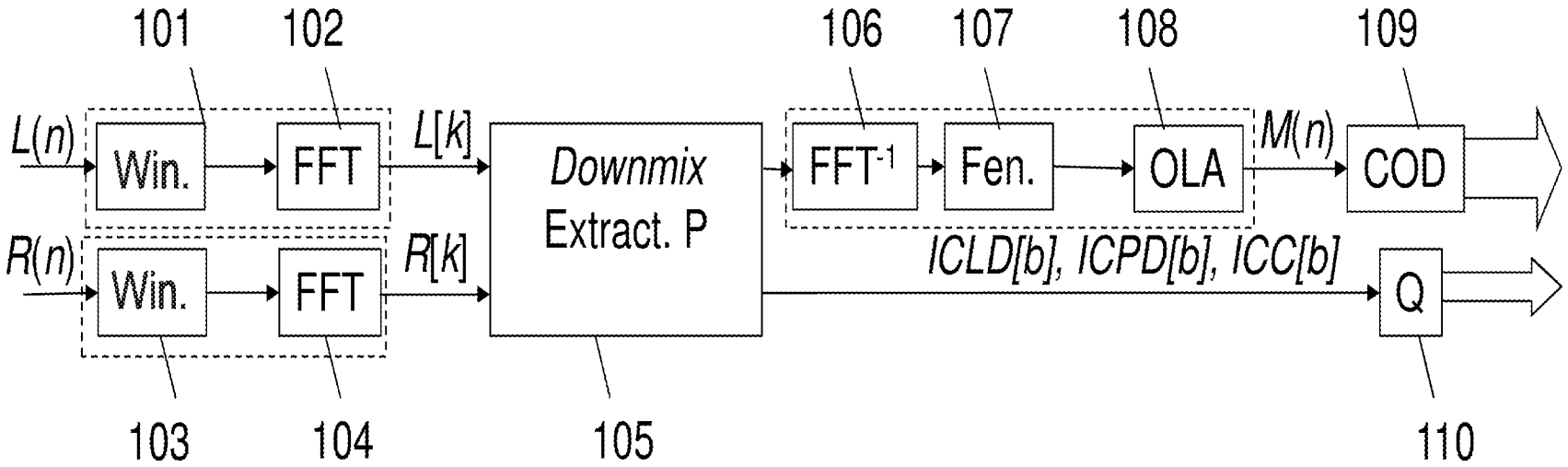
Fig.1 (Prior art)
FIG. 1 illustrates a coder implementing a parametric coding known from the prior art and described previously.
Figure 2:
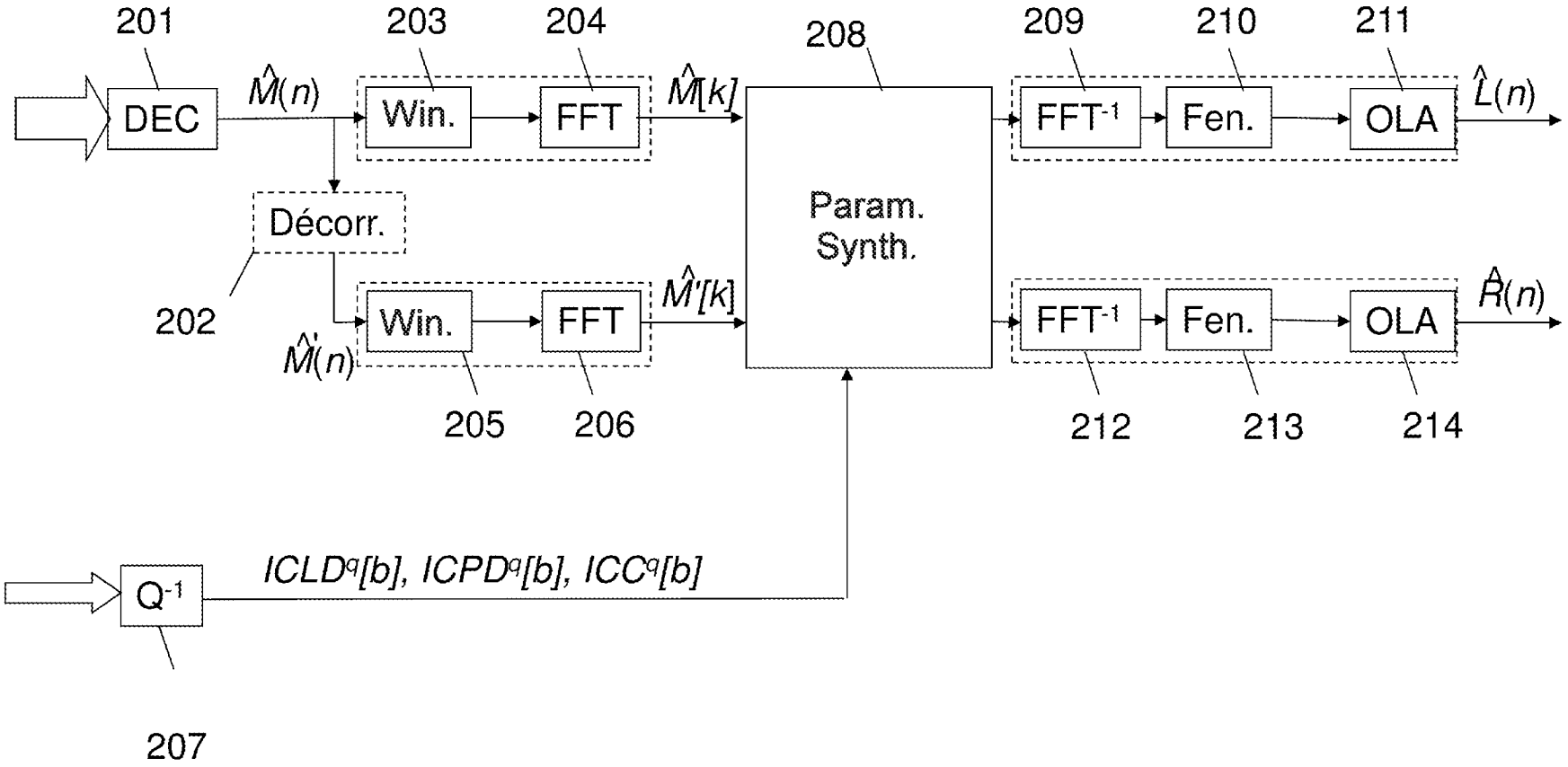
Fig.2 (Prior art)
FIG. 2 illustrates a decoder implementing a parametric decoding known from the prior art and described previously.
Figure 3:
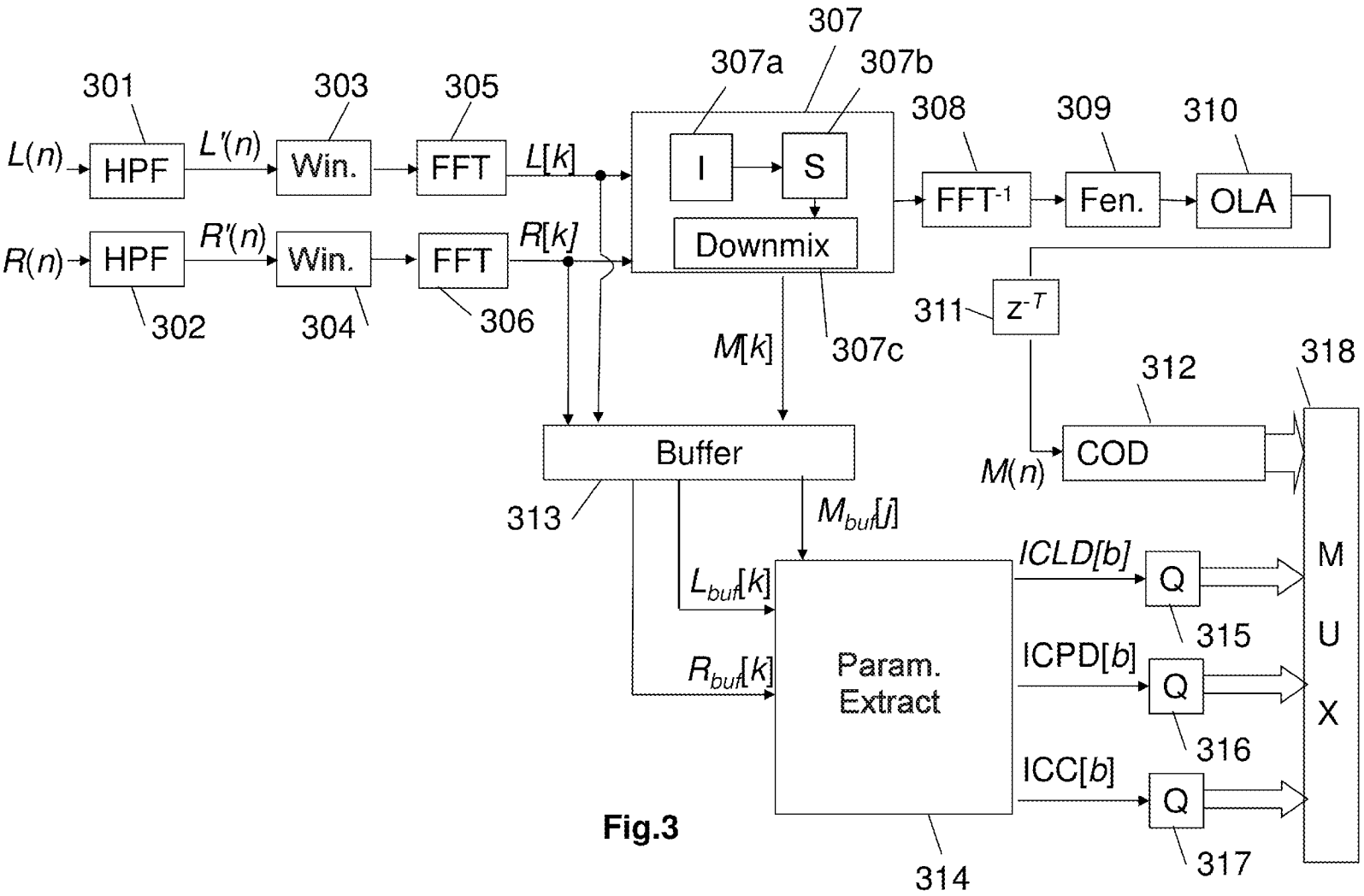
FIG. 3 illustrates a stereo parametric coder according to an embodiment of the invention.

Referring to FIG. 3, a stereo signal parametric coder according to an embodiment of the invention, delivering both a mono signal and stereo signal spatial information parameters, is now described.

This figure presents both the entities, hardware or software modules driven by a processor of the coding device, and the steps implemented by the coding method according to an embodiment of the invention.

The case of a stereo signal is described here. The invention applies also to the case of a multi-channel signal with a number of channels greater than two.

This parametric stereo coder as illustrated uses a mono coding of standardized EVS type, it operates with stereo signals sampled at the sampling frequency $F_s$ of 8, 16, 32 and 48 kHz, with 20 ms frames. Hereinbelow, with no loss of generality, the description is primarily given for the case $F_s$=16 kHz.

It should be noted that the choice of a 20 ms frame length is in no way restrictive in the invention which applies equally to variants of the embodiment in which the frame length is different, for example 5 or 10 ms, with code other than EVS.

Moreover, the invention applies equally to other types of mono coding (e.g.: IETF OPUS, ITU-T G.722) operating at sampling frequencies that are identical or not.

Each time channel (L(n) and R(n)) sampled at 16 kHz is first of all prefiltered by a high-pass filter (HPF) typically eliminating the components below 50 Hz (blocks 301 and 302). This prefiltering is optional, but it can be used to avoid the bias due to the DC component in the estimation of parameters like the ICTD or ICC.

The L'(n) and R'(n) channels derived from the prefiltering blocks are frequency analyzed by discrete Fourier transform with sinusoidal windowing with 50% overlap of 40 ms length, i.e. 640 samples (blocks 303 to 306). For each frame, the signal (L'(n), R' (n)) is therefore weighted by a symmetrical analysis window covering 2 20 ms frames, i.e. 40 ms (i.e. 640 samples for $F_s$=16 kHz). The 40 ms analysis window covers the current frame and the future frame. The future frame corresponds to a "future" signal segment commonly called "lookahead" of 20 ms. In variants of the invention, other windows will be able to be used, for example an asymmetrical window with low delay called "ALDO" in the EVS codec. Furthermore, in variants, the analysis windowing will be able to be made adaptive as a function of the current frame, in order to use an analysis with a long window, on stationary segments and an analysis with short windows on transient/non-stationary segments, possibly with transition windows between long and short windows.

For the current frame of 320 samples (20 ms at $F_s$=kHz), the spectra obtained, L[k] and R[k] (k=0 . . . 320), comprise 321 complex coefficients, with a resolution of 25 Hz for each frequency coefficient. The coefficient of index k=0 corresponds to the DC component (0 Hz), it is real. The coefficient of index k=320 corresponds to the Nyquist frequency (8000 Hz for $F_s$=16 kHz), it is also real. The coefficients of index 0<k<160 are complex and correspond to a sub-band of 25 Hz width centered on the frequency of k.

The spectra L[k] and R[k] are combined in the block 307 described later to obtain a mono signal (downmix) M[k] in the frequency domain. This signal is converted over time by inverse FFT and window-overlap with the "lookahead" part of the preceding frame (blocks 308 to 310).

The algorithmic delay of the EVS codec is 30.9375 ms at $F_s$=8 kHz and 32 ms for other frequencies $F_s$=16, 32 or 48 kHz. This delay includes the current 20 ms frame, the additional delay relative to the frame length is therefore 10.9375 ms at $F_s$=8 kHz and 12 ms for the other frequencies (i.e. 192 samples at $F_s$=16 kHz), the mono signal is delayed (block 311) by T=320−192=128 samples so that the aggregate delay between the mono signal decoded by EVS and the original stereo channels becomes a multiple of the frame length (320 samples). Consequently, to synchronize the extraction of stereo parameters (block 314) and the spatial synthesis from the mono signal performed on the decoder, the lookahead for the computation of the mono signal (20 ms) and the mono coding/decoding delay to which the delay T is added to align the mono synthesis (20 ms) correspond to an additional delay of 2 frames (40 ms) relative to the current frame. This delay of 2 frames is specific to the implementation detailed here, and in particular it is linked to the 20 ms sinusoidal symmetrical windows. This delay could be different. In a variant embodiment, it would be possible to obtain a delay of one frame with an optimized window with a smaller overlap between adjacent windows with a block 311 not introducing delay (T=0).

The offset mono signal is then coded (block 312) by the mono EVS coder for example at a bit rate of 13.2, 16.4 or 24.4 kbit/s. In variants, the coding will be able to be performed directly on the non-offset signal; in this case, the offsetting will be able to be performed after decoding.

In a particular embodiment of the invention, illustrated here in FIG. 3, it is considered that the block 313 introduces a delay of two frames on the spectra L[k], R[k] and M[k] in order to obtain the spectra $L_{buf}[k]$, $R_{buf}[k]$ and $M_{buf}[k]$.

It would be possible, more advantageously in terms of quantity of data to be stored, to offset the outputs of the parameter extraction block 314 or even the outputs of the quantization blocks 315, 316 and 317. It would also be possible to introduce this offset on the decoder on reception of the stereo enhancement layers.

In parallel with the mono coding, the coding of the stereo spatial information is implemented in the blocks 314 to 317.

The stereo parameters are extracted (block 314) and coded (blocks 315 to 317) from the spectra L[k], R[k] and M[k] offset by two frames: $L_{buf}[k]$, $R_{buf}[k]$ and $M_{buf}[k]$.

The downmix processing block 307 is now described in more detail.

This, according to one embodiment of the invention, performs a downmix in the frequency domain to obtain a mono signal M[k].

This processing block 307 comprises a module 307*a* for obtaining at least one indicator characterizing the channels of the multi-channel signal, here the stereo signal. The indicator can for example be an indicator of inter-channel correlation type or an indicator of measurement of degree of phase opposition between the channels. The obtaining of these indicators will be described later.

Based on the value of this indicator, the selection block 307*b* selects, from a set of downmix processing modes, a downmix processing mode which is applied in 307*c* to the signals at the input, here to the stereo signal L[k], R[k] to give a mono signal M[k].

FIGS. 4*a* to 4*f* illustrate different embodiments implemented by the processing block 307.

To present these figures and simplify the descriptions thereof, several parameters are first of all defined:

Parameter ICPD[k]

The parameter ICPD[k] is computed in the current frame for each frequency line k according to the formula:

$$\mathrm{ICPD}[k]=\angle(L[k].R^*[k]) \tag{13}$$

This parameter corresponds to the phase difference between the L and R channels. It is used here to define the parameter ICCr.

Parameter ICCr[m]

A correlation parameter is computed for the current frame as follows:

$$ICCp=\left|\frac{\sum_{k=1}^{\frac{N_{FFT}}{2}+1} L[k]\cdot R^*[k]e^{j\cdot ICPD[k]}}{\sqrt{\left(\sum_{k=1}^{\frac{L}{2}+1} L[k]\cdot L^*[k]\right)\left(\sum_{k=1}^{\frac{L}{2}+1} R[k]\cdot R^*[k]\right)+\in}}\right| \tag{14}$$

where $N_{FFT}$ is the length of the FFT (here $N_{FFT}$=640 for $F_S$=16 kHz). In variants, the complex module |.| will be able to not be applied, but in this case the use of the parameter ICCp (or of its derivatives) will have to take account of the signed value of this parameter.

It should be noted that the division in the computation of the parameter ICCp can be avoided because the ICCp (smoothed according to the equation (16) hereinbelow) is then compared to a threshold; it is common practice to add a non-zero low value ε to the denominator to avoid a division by zero, this precaution is in fact pointless and it will be possible to set ε=0 in practice if the numerator and the denominator are computed separately. In the embodiments of the invention this division is not necessary because the parameter ICCp (or its possibly smoothed version ICCr defined hereinbelow) is compared to a threshold; the absence of division in the implementation is advantageous in terms of complexity. However, to simplify the following description, the notation involving a division is retained.

This parameter can optionally be smoothed to attenuate the time variations. If the current frame is of index m, this smoothing can be computed with a $2^{nd}$ order MA (moving average) filter:

$$\mathrm{ICC}r[m]=0.5\cdot\mathrm{ICC}p[m]+0.25\cdot\mathrm{ICC}p[m-1]+0.25\cdot\mathrm{ICC}p[m-2] \tag{15}$$

In practice, since the division in the definition of ICCr[m] has not been explicitly computed, this MA filter will advantageously be applied separately to the values of the numerator and of the denominator.

Then, the parameter ICCr will be used to designate ICCr[m] (without mentioning the index of the current frame); if the smoothing has not been applied, the parameter ICCr will correspond directly to ICCp. In variants, other smoothing methods will be able to to be implemented, for example by using an AR (auto regressive) filter, by smoothing the signals.

The parameter ICCr makes it possible to quantify the level of correlation between the L and R channels when the phase differences between these channels are disregarded.

In variants, the parameter ICCp will be able to be defined for each sub-band by simply changing the bounds of the sums, as follows:

$$ICCp[b]=\left|\frac{\sum_{k=k_b}^{k_{b+1}-1} L[k]\cdot R^*[k]e^{j\cdot ICPD[k]}}{\sqrt{\left(\sum_{k=k_b}^{k_{b+1}-1} L[k]\cdot L^*[k]\right)\left(\sum_{k=k_b}^{k_{b+1}-1} R[k]\cdot R^*[k]\right)+\in}}\right|$$

where $k_b \ldots k_{b+1}-1$ represent the indices of the frequency lines in the sub-bands of index b. Here again, the parameter ICCp[b] will be able to be smoothed and in this case the invention will be implemented as follows: instead of having a single comparison to ICCr[m], there will be as many comparisons to ICCp[b] as there are sub-bands of index b.

Parameter SGN[m]

The dominant channel is also identified in order to use it as phase reference. For example, this dominant channel can be determined via a parameter of sign SGN computed for the current frame as the sign of the difference in levels of the L and R channels:

$$SGN_d = \text{sign}\left(\sum_{k=1}^{\frac{L}{2}+1} |L[k]| - \sum_{k=1}^{\frac{L}{2}+1} |R[k]|\right) \tag{16}$$

where the function sign(.) takes for its value 1 or −1 if its operand is respectively ≥0 or <0.

It is important to note that the change of reference (L or R) for the alignment of the mono signal (derived from the downmix) on the phase of L or of R is done only under certain conditions. That makes it possible to avoid phase problems in the overlap-add operation after inverse transform, when the phase reference switches arbitrarily from L to R or vice versa.

In the preferred embodiment, it is defined that the switch over is authorized only when the signal is weakly correlated and this phase is not used in the current frame because the downmix is, in this case, of passive type (see below for the details of the different downmixes used). Thus, the value of $SGN_d$ in the current frame will be disregarded if this condition is not filled; the switch of phase reference will be authorized only when the value of ICCr in the current frame is less than a predetermined threshold, for example ICCr<0.4. The following will therefore be posited:

```
If = 1,SGN[m] = 1 (initial choice arbitrarily set on
L channel)
Else
  If ICCr[m]<0.4
    SGN[m] = SGN_d
  End if
End if
```

In variants, the value of 0.4 will be able to be modified, but it corresponds here to the threshold th1=0.4 used later.

In variants, the initial choice SGN[1] will be able to be modified to SGN[1]=$SGN_d$ to ensure that the phase reference corresponds to the dominant signal in the first frame, even if the latter by definition comprises only 20 ms of signal out of 40 ms used (for the frame size used here preferentially).

In variants, the condition to authorize a phase reference switch over will be able to be defined for each frequency line and depend on the type of downmix used on the current frame (of index m) and on the type of downmix used on the preceding frame (of index m−1); in effect, if the downmix for the line of index k in the frame m−1 was of passive type (with gain compensation) and if the downmix selected on the frame m is a downmix with alignment on an adaptive phase reference, in this case it will be possible to authorize a phase reference switch over. In other words, the phase reference switch over is prohibited for the line of index k as long as the downmix explicitly uses the phase reference corresponding to the parameter SGN.

The sign parameter SGN[m] therefore changes value only when ICCr is below a threshold (in the preferred embodiment). This precaution avoids changing phase reference in zones where the channels are very correlated and potentially in phase opposition. In variants, another criterion will be able to be used to define the phase reference switch over conditions.

In variants of the invention, the binary decision associated with the computation of $SGN_d$ will be able to be stabilized to avoid potentially rapid fluctuations. It will thus be possible to define a tolerance, for example of +/−3 dB, on the value of the level of the L and R channels, in order to implement a hysteresis preventing the change of phase reference if the tolerance is not exceeded. It will also be possible to apply an inter-frame smoothing to the value of the level of the signal.

In other variants, the parameter $SGN_d$ will be able to be computed with another definition of the level of the channels, for example:

$$SGN_d = \text{sign}\left(\sum_{k=1}^{\frac{L}{2}+1} |L[k]|^2 - \sum_{k=1}^{\frac{L}{2}+1} |R[k]|^2\right) \tag{17}$$

or even from the ICLD parameters in the following form:

$$SGN_d = \text{sign}(\Sigma_{b=1}^{B} 20^{ICPD[k]/10} - B) \tag{18}$$

where B is the number of sub-bands, or in a non-equivalent manner $$SGN_d = \text{sign}(\Sigma_{b=1}^{B} ICPD[k]) \tag{19}$$

In other variants, it will be possible to compute the level of the different channels in the time domain.

In variants of the invention, the explicit computation $SGN_d$ will not be performed and a parameter representing the level of each channel (L or R) will be computed separately. At the time of use of $SGN_d$, a simple comparison will be performed between these respective levels. The implementation is in fact strictly equivalent but it avoids explicitly computing a sign.

Parameter ISD[k]

A parameter ISD[k] defined for each line of the current frame and making it possible to detect a phase opposition is also computed:

$$ISD[k] = \left|\frac{L[k] - R[k]}{L[k] + R[k]}\right| \tag{20}$$

When the L and R channels are phase-opposed, the value ISD become arbitrarily great.

It should be noted that the division in the computation of the parameter ISD can be avoided because the ISD is then compared to a threshold; it is common practice to add a non-zero low value to the denominator to avoid a division by zero, this precaution is pointless here because, in the embodiments of the invention, this division is not implemented. In effect, the comparison of ISD[k]>th0 is equivalent to the comparison |L[k]−R[k]|>th0·|L[k]+R[k]|, which renders the downmix mode selection process attractive in terms of complexity.

Figure 4A:
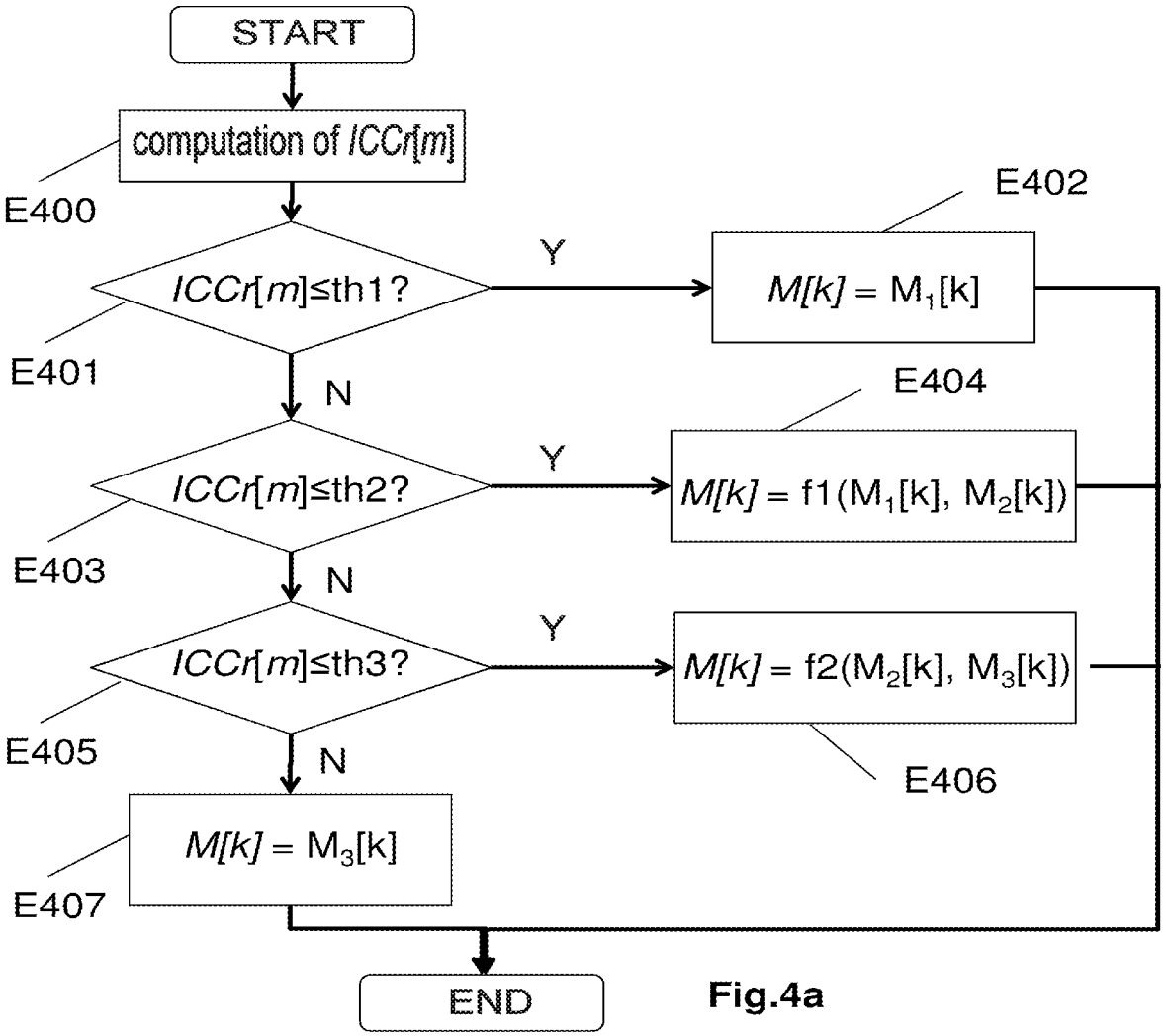
FIGS. 4*a*, 4*b*, 4*c*, 4*d*, 4*e* and 4*f* illustrate, in flow diagram form, the steps of the downmix processing according to different embodiments of the invention.

In a first embodiment, FIG. 4*a* illustrates the steps implemented for the downmix processing of the block 307.

In the step E400, an indicator characterizing the channels of the multi-channel audio signal is obtained. In the example illustrated here, it is the parameter ICCr as defined above, computed from the parameter ICPD. The indicator ICCr corresponds to a measurement of correlation between the channels of the multi-channel signal, in the particular case here between the channels of the stereo signal.

As illustrated in this FIG. 4*a*, the choice of the downmix depends primarily on the indicator ICCr[m] computed as explained previously from the L and R channels of the current frame and a possible smoothing.

The choice between downmix processing modes is made as a function of the value of the indicator ICCr[m].

Several downmix processing modes are provided and form part of a set of downmix processing modes.

The computation of the downmix signal is done line by line as follows, by using three potential downmixes which are listed below:

1. Downmix of Passive Type (with Gain Compensation).

This downmix $M_1[k]$ is defined as a sum sign with equalization of the energy in the form:

$$M_1[k] = \frac{L[k] + R[k]}{2} \cdot \gamma[k]$$

where y[k] is defined such that $M_1[k]$ is equivalent to:

$$\begin{cases} |M_1[k]| = \dfrac{|L[k]| + |R[k]|}{2} \\ \angle M_1[k] = \angle(L[k] + R[k]) \end{cases}$$

The following is defined:

$$\gamma[k] = \frac{|L[k]| + |R[k]|}{|L[k] + R[k]|}$$

This downmix is effective for the stereo signals (and their frequency decompositions by line or sub-bands) for which the channels are not very correlated and do not have a complex phase relationship. Since it is not used for problematic signals where the gain y[k] could take arbitrary great values, no limitation of the gain is used here, but, in variants, a limitation of the amplification could be implemented.

In variants, this equalization by the gain y[k] will be able to be different. For example it would be possible to take the value already cited:

$$\gamma[k] = \max\left(2, \sqrt{\frac{|L[k]|^2 + |R[k]|^2}{|L[k] + R[k]|^2/2}}\right)$$

The benefit of the gain y[k] here lies in that it ensures the same level of amplitude for the downmix $M_1[k]$ as for the other downmixes used. It is therefore preferable to adjust the gain y[k] to ensure a uniform amplitude or energy level between the different downmixes.

2. Downmix with Alignment on an Adaptative Phase Reference

This downmix $M_3[k]$ is defined as follows:

$$\begin{cases} |M_3[k]| = \dfrac{|L[k]| + |R[k]|}{2} \\ \angle M_3[k] = \dfrac{1 + \mathrm{SGN}}{2} \cdot \angle L[k] + \dfrac{1 - \mathrm{SGN}}{2} \cdot \angle R[k] \end{cases}$$

where the value of SGN should be understood to be the value SGN[m] in the current frame, but, to lighten the notations, the index of the frame is not mentioned here.

As explained previously, the phase of this downmix can also be expressed in an equivalent manner as:

$$\angle M_3[k] = \begin{cases} \angle L[k] \text{ if level } L > \text{level } R \\ \angle R[k] \text{ if level } R > \text{level } L \end{cases}$$

This downmix is similar to the downmix proposed by the abovementioned Samsudin method, but here the reference phase is not given by the L channel and the phase is determined line by line and not at the level of a frequency band.

The phase is here set as a function of the dominant channel identified by the parameter SGN.

This downmix is advantageous for the highly correlated signals, for example for the signals with sound picked up with microphones of AB or binaural type. It may also be that independent channels have a fairly strong correlation even if it does not concern the same signal recorded in the L and R channels; to avoid an untimely switch over of the phase reference, it is preferable to authorize such a switch over only when these signals do not present any risk of generating audio artifacts when this downmix is used. This explains the constraint ICCr[m]<0.4 in the computation of the parameter SGN[m] when the phase reference switch over condition uses this criterion.

3. Hybrid downmix with a passive downmix (with gain compensation) and a downmix with alignment on an adaptive phase reference, dependent on an indicator of measurement of degree of phase opposition between the channels (ISD[k], as defined above).

This downmix $M_2[k]$ is defined as follows:

```
If ISD[k]>th0 (th0=1.3),
   M2[k] = M3[k]
Else
   M2[k] = M1[k]
End if
```

This downmix is applied here in the cases where the signals are moderately correlated and where they are potentially in phase opposition. The parameter ISD[k] is used here to detect a phase relationship close to the phase opposition, and in this case it is preferable to select the downmix with alignment on an adaptive phase reference $M_3[k]$; otherwise, the passive downmix with gain compensation $M_1[k]$ is sufficient.

In variants, the threshold th0=1.3 applied to ISD[k] will be able to take other values.

It will be noted that the downmix $M_2[k]$ corresponds either to $M_1[k]$ or to $M_3[k]$, depending on the value of the parameter ISD[k]. It will be understood that, in variants of the invention, it will therefore be possible to not explicitly define this downmix $M_2[k]$ but to combine the decisions on the selection of the downmix and the criterion on ISD[k]. Such an example is given in FIG. 4*c*, but it is clear that this example does of course apply to all the embodiments presented here.

Thus, according to FIG. 4*a*, if, in the step E401, the indicator is less than a first threshold th1, then a first downmix processing mode M1 is implemented in the step E402.

If $ICCr[m] \leq 0.4$(step $E401$ with $th1=0.4$)

$M[k]=M_1[k]$

If, in the step E403, the indicator is less than a second threshold th2, then a second downmix processing mode dependent on M1 and M2 is implemented in the step E404.

If $0.4<ICCr[m] \leq 0.5$ (step $E403$ with $th2=0.5$)

$M[k]=f1(M_1[k],M_2[k])$

If, in the step E405, the indicator is less than a third threshold th3, then a third downmix processing mode that is a function of M2 and M3 is implemented in the step E406.

If $0.5<ICCr[m] \leq 0.6$ (step $E405$ with $th3=0.6$)

$M[k]=f2(M_2[k],M_3[k])$

Finally, if, in the step E405, the indicator is greater than the third threshold th3, then a fourth downmix processing mode M3 is implemented in the step E407.

If $ICCr[m]>0.6$ (step $E405,N$)

$M[k]=M_3[k]$

In variants of the invention, the values of the thresholds th1, th2, th3 will be able to be set at other values; the values given here correspond typically to a frame length of 20 ms.

Figure 6:
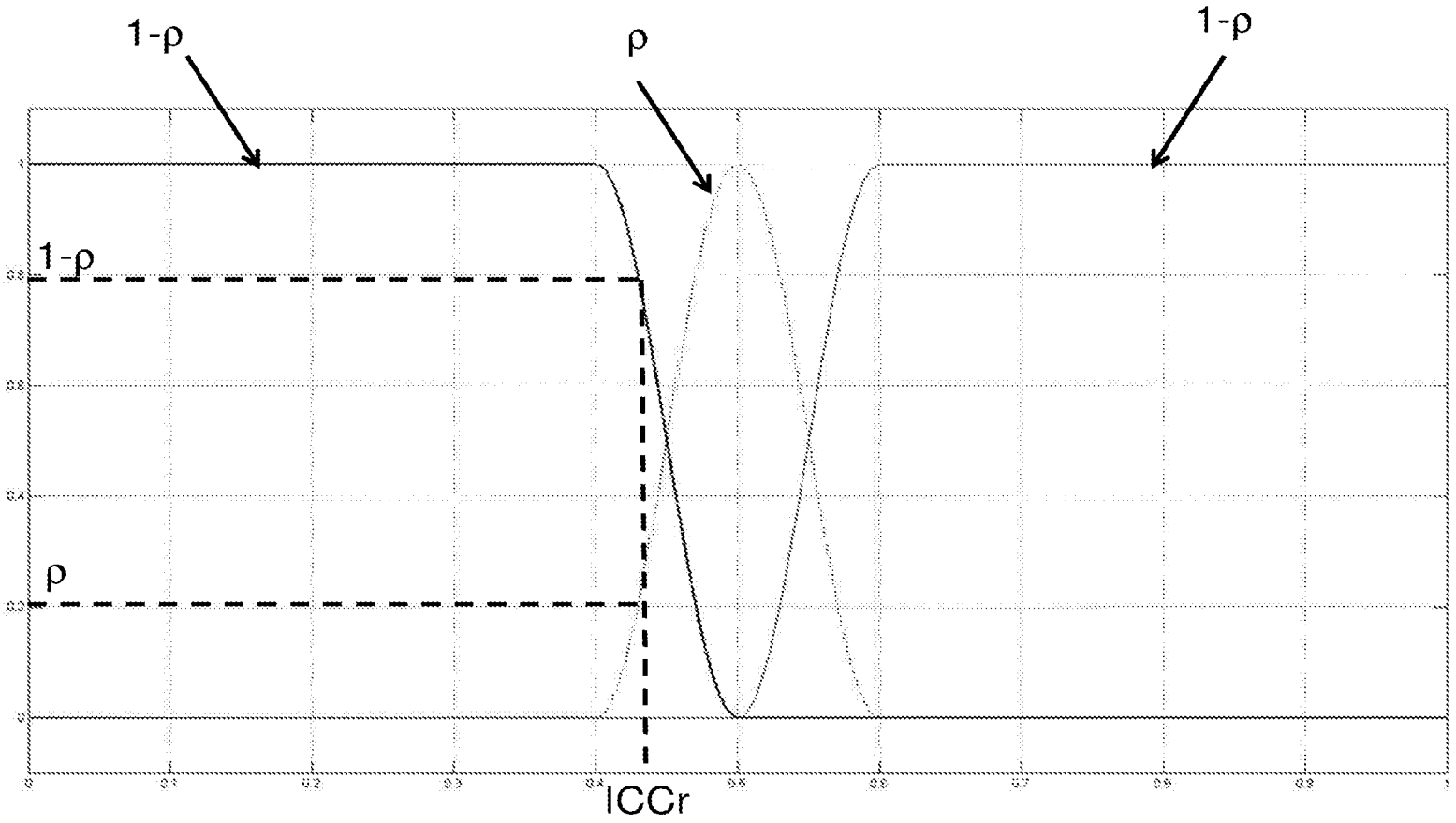
FIG. 6 illustrates an example of possible weightings as a function of the value of an indicator characterizing the channels of a signal according to an embodiment of the invention.

The weighting functions of the combination functions $f1(\ldots)$ and $f2(\ldots)$ are illustrated in FIG. 6. These combination functions produce a "cross fading" between different downmixes in order to avoid the threshold effects, that is to say transitions that are too abrupt between the respective downmixes from one frame to another for a given line. Any weighting functions having complementary values between 0 and 1 are suitable in the defined interval, but, in the embodiment, these functions are derived from the function:

$$\rho = \begin{cases} \cos^2\left(\frac{\pi}{2} \cdot \frac{ICCr[m]-0.5}{0.1}\right) & \text{for } 0.4 \leq ICCr[m] \leq 0.6 \\ 0 & \text{in other words} \end{cases}$$

with $$f1(M_1[k],M_2[k])=(1-\rho),M_1[k]+\rho,M_2[k]$$

and $$f2(M_2[k],M_3[k])=(1-\rho),M_3[k]+\rho,M_2[k]$$

It will be noted that the parameter ICCr[m] is here defined at the current frame level; in variants, this parameter will be able to be estimated for each frequency band (for example according to the ERB or Bark scale)

Figure 4B:
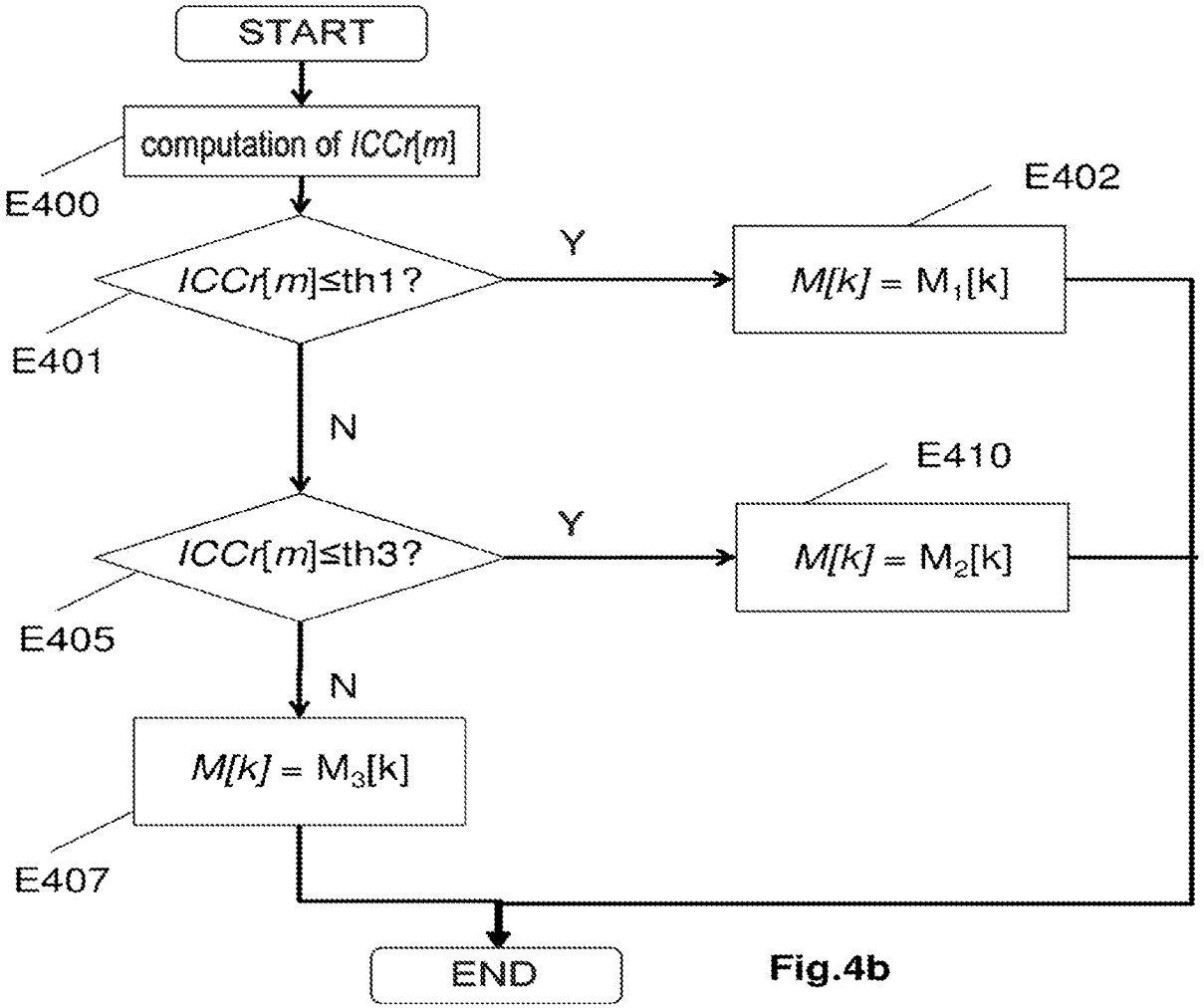

In a second embodiment, FIG. 4*b* illustrates the steps implemented for the downmix processing of the block 307. The aim of this variant embodiment is to simplify the decision on the downmix method to be used and to reduce the complexity by not implementing the cross fading between two downmix methods.

The steps E400, E401, E402, E405 and E407 are identical to those described with reference to FIG. 4*a*.

Thus, according to FIG. 4*b*, if, in the step E401, the indicator is less than a first threshold th1, then a first downmix processing mode M1 is implemented in the step E402.

If $ICCr[m] \leq 0.4$ (step $E401$ with $th1=0.4$)

$M[k]=M_1[k]$

If, in the step E405, the indicator is less than a threshold th3, then a second downmix processing mode M2 is implemented in the step E410.

If $0.4<ICCr[m] \leq 0.6$ (step $E405$ with $th3=0.6$)

$M[k]=M_2[k]$

Finally, if, in the step E405, the indicator is greater than the threshold th3, then a third downmix processing mode M3 is implemented in the step E407.

If $ICCr[m]>0.6$ (step $E405,N$)

$M[k]=M_3[k]$

The downmix methods M1, M2 and M3 are for example those described previously.

Note that the downmix M2 is a hybrid downmix between the downmix M1 and M3 which involves another decision criterion on another indicator ISD as defined previously.

Figure 4C:
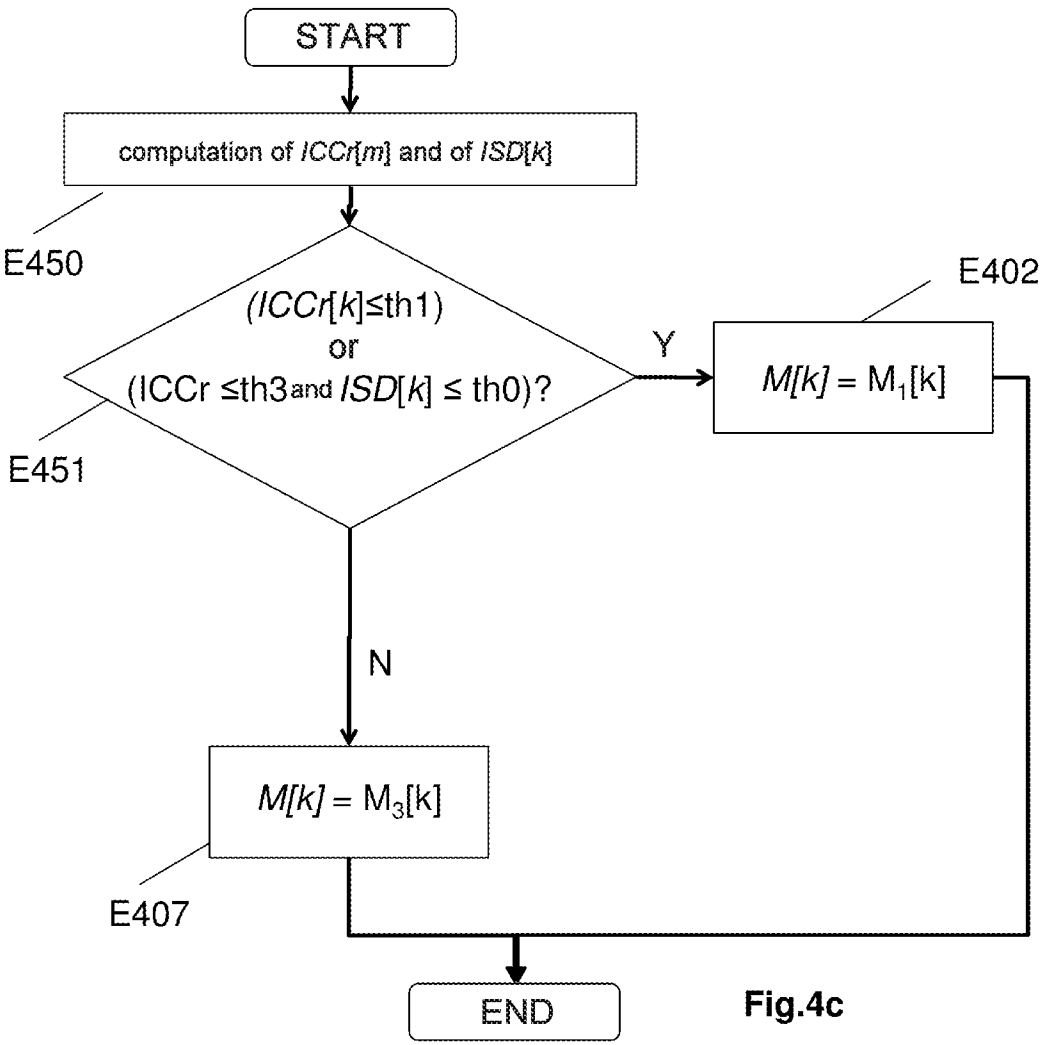

An embodiment strictly identical in terms of result to FIG. 4*b* is shown in FIG. 4*c*. In this variant, the evaluation of the selection parameters (block E450) and the downmix selection decisions (block E451) are gathered together.

Figure 4D:
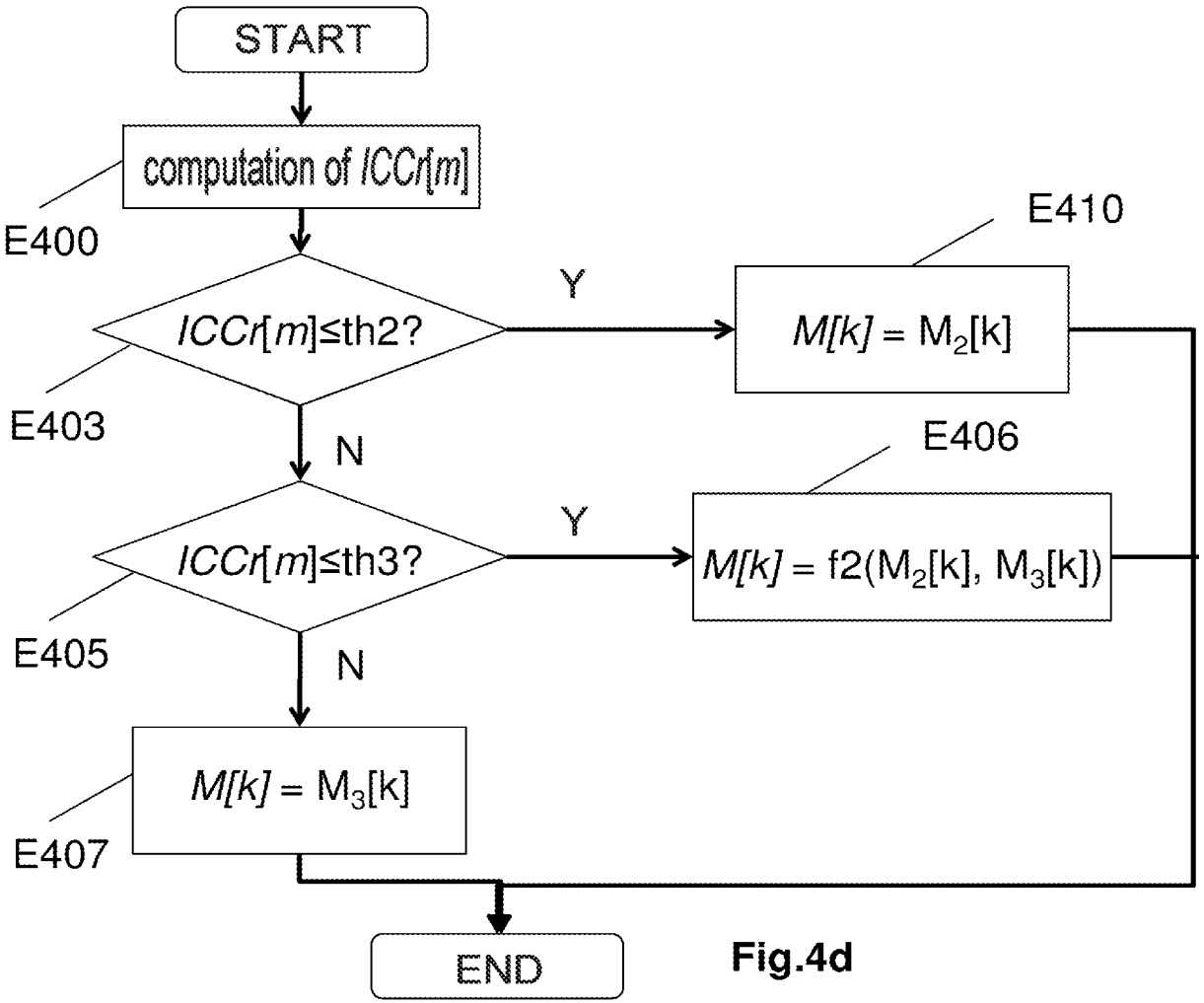

In a third embodiment, FIG. 4*d* illustrates the steps implemented for the downmix processing of the block 307. The aim of this variant embodiment is to simplify the decision on the downmix method to be used, this time by not using the passive downmix $M_1[k]$. In effect this passive downmix is in fact already included in the hybrid downmix $M_2[k]$; furthermore, it can be considered that the hybrid downmix is a more robust variant than the downmix $M_1[k]$ because it makes it possible to avoid the problems of phase opposition.

The downmix in FIG. 4*d* is computed as follows:

If, in the step E403, the indicator is less than a threshold th2, then the downmix processing M2 is implemented in the step E410.

If $ICCr[m] \leq 0.5$ (step $E403$ with $th2=0.5$)

$M[k]=M_2[k]$

If, in the step E405, the indicator is less than a threshold th3, then a downmix processing mode that is a function of $M_2$ and M3 is implemented in the step E406.

If $0.5<ICCr[m] \leq 0.6$ (step $E405$ with $th3=0.6$)

$M[k]=f2(M_2[k],M_3[k])$

Finally, if, in the step E405, the indicator is greater than the threshold th3, then a downmix processing mode M3 is implemented in the step E407.

If $ICCr[m]>0.6$ (step $E405,N$)

$M[k]=M_3[k]$

In a variant not represented here, it will be possible not to use the cross fading and thus eliminate the E405 decision in FIG. 4*d*.

It will be noted that the embodiment of FIG. 4*d* is strictly equivalent to that of FIG. 4*d* by setting th1 at a value≤0.

Figure 4E:
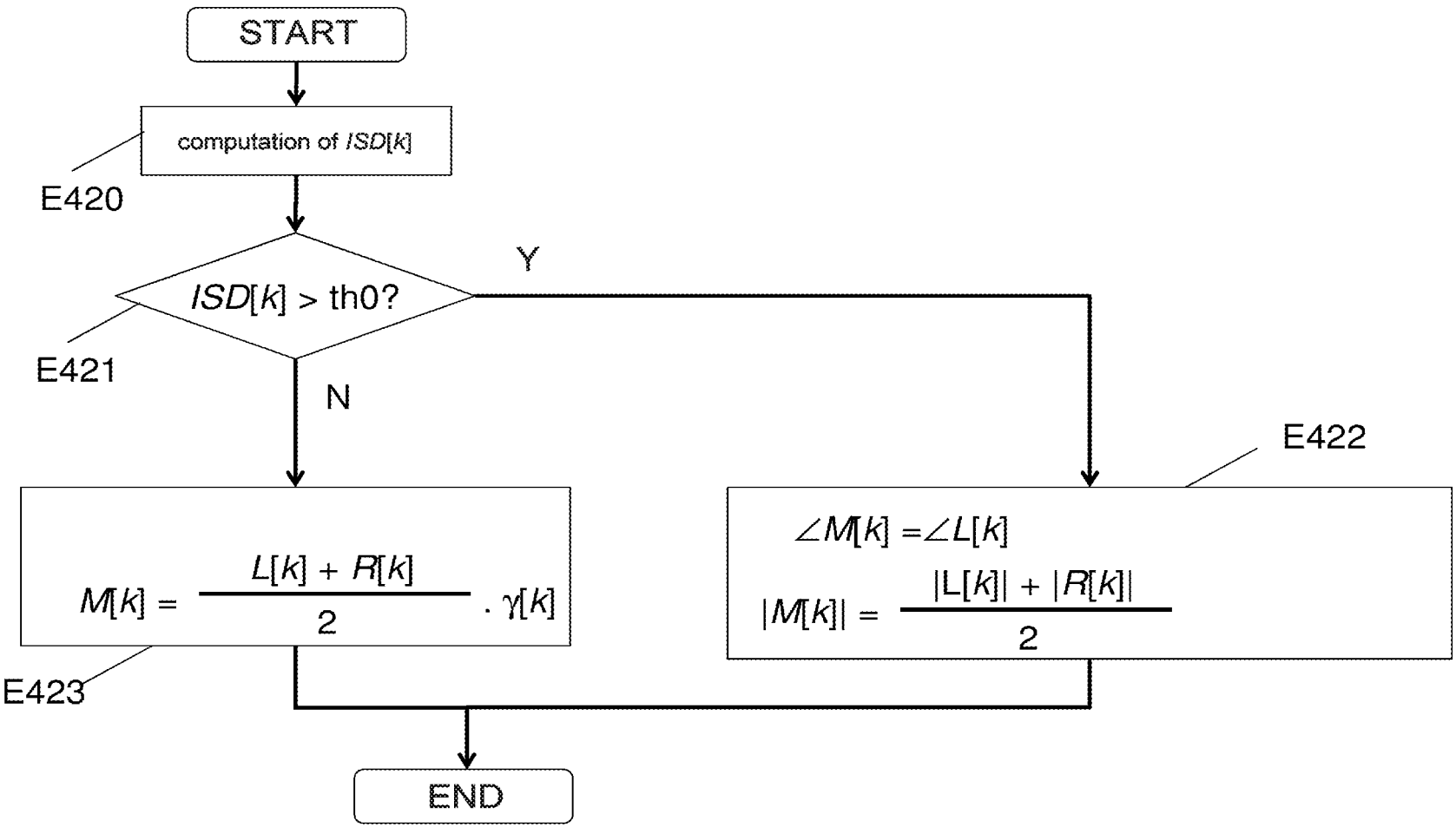

In a fourth embodiment, FIG. 4*e* illustrates the steps implemented for the downmix processing of the block 307. In this embodiment, the indicator characterizing the channels of the multi-channel digital audio signal is the phase indicator ISD representative of a measure of degree of phase opposition of the channels of the multi-channel signal.

It is determined in the step E420. For a stereo signal, this parameter is as defined in the equation (18) for a computation for each spectral line.

Thus, according to FIG. 4*e*, if, in the step E421, the indicator ISD[k] is greater than a threshold th0, then a first downmix processing mode is implemented in the step E422.

If $ISD[k]>1.3$ (0 from step $E421$ with $th0=1.3$)

then the downmix processing is defined as follows:

$$\angle M[k] = \angle L[k]$$

$$|M[k]| = \frac{|L[k]| + |R[k]|}{2}$$

If, in the step E421, the indicator ISD[k] is less than the threshold th0, then a second downmix processing mode is implemented in the step E423.

If $ISD[k]<1.3$ ($N$ from the step $E421$ with $th0=1.3$)

then the downmix processing M1[k] is applied. It is defined as follows:

$$M[k] = \frac{L[k] + R[k]}{2} \cdot \gamma[k]$$

Figure 4F:
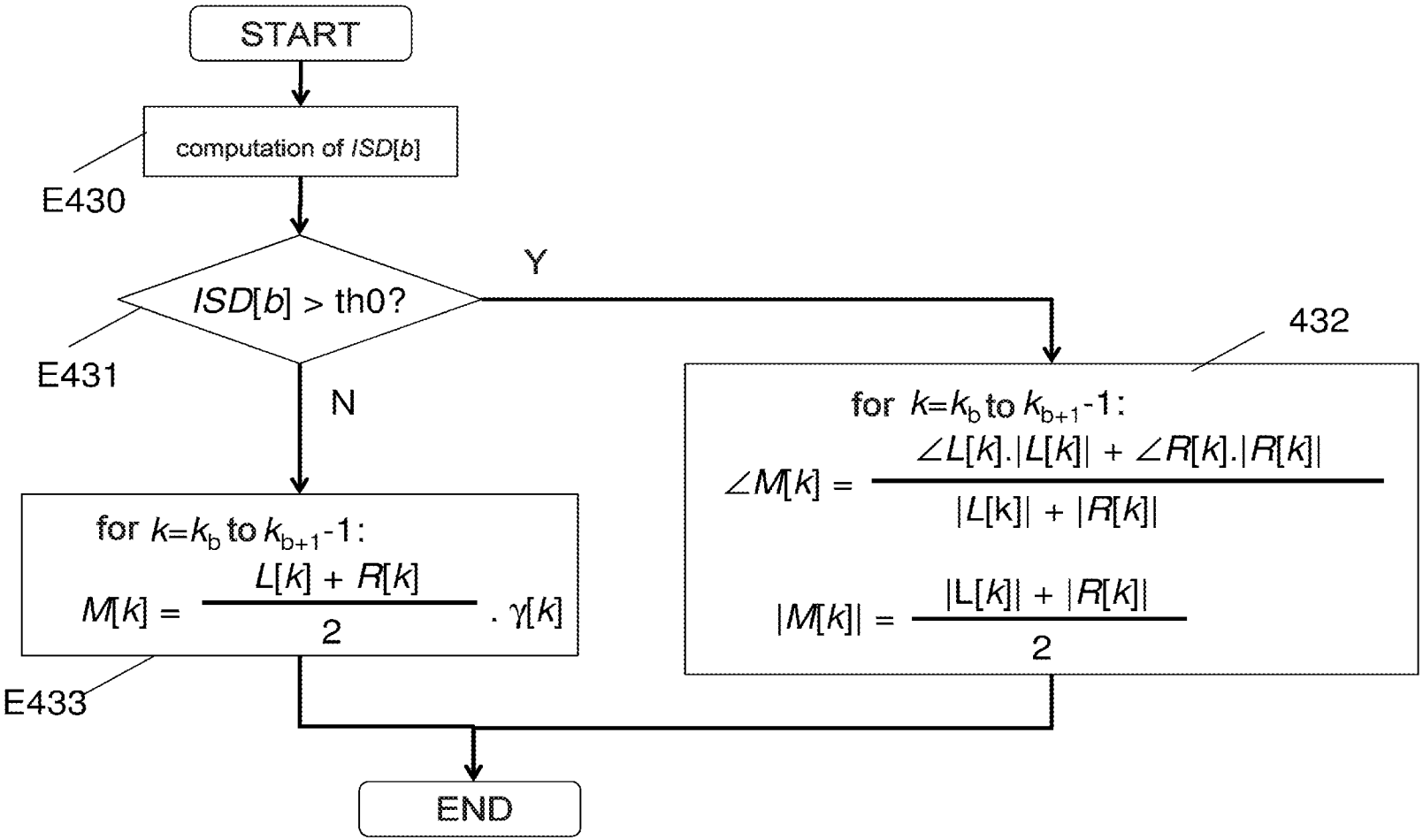

Finally, a variant of the determination of the downmix signal of FIG. 4*e* is presented in FIG. 4*f*. In this variant the main downmix mode selection criterion is defined as being the parameter ISD as in FIG. 4*e*, but this parameter is this time defined for each sub-band in the step E430, ISD[b] where b is the index of the frequency sub-band (typically ERB or Bark). In this variant, when the phase relationship between the L and R channels is close to the phase opposition (threshold ISD[b]>1.3), in the step E431, the downmix mode selected is, this time, similar to the method defined in annex D of G.722 but in a more direct way without using full band IPD.

Thus, according to FIG. 4*f*, if, in the step E431, the indicator ISD[b] is greater than a threshold th0, then a first downmix processing mode is implemented in the step E432.

If $ISD[k]>1.3$ (0 from the step $E431$ with $th0=1.3$)

then the downmix processing is defined as follows (downmix with alignment on an adaptive phase reference, M3):

$$\text{for } k = k_b \ldots k_{b+1} - 1$$

$$\angle M[k] = \frac{\angle L[k] \cdot |L[k]| + \angle R[k] \cdot |R[k]|}{|L[k]| + |R[k]|}$$

$$|M[k]| = \frac{|L[k]| + |R[k]|}{2}$$

If, in the step E431, the indicator ISD[b] is less than the threshold th0, then a second downmix processing mode is implemented in the step E433.

If $ISD[b]<1.3$ ($N$ from the step $E431$ with $th0=1.3$)

then the downmix processing is defined as follows (passive downmix with gain compensation, M1):

$$\text{for } k = k_b \ldots k_{b+1} - 1$$

$$M[k] = \frac{L[k] + R[k]}{2} \cdot \gamma[k]$$

In additional variants, it will be possible to add additional decision/classification criteria in order to more closely refine the choice of the downmix, but at least one decision will be kept between at least two downmix modes depending on the value of at least one indicator characterizing the channels of the multi-channel signal such as, for example, the parameter ICCr or the parameter ISD (over the frame, for each sub-band, or for each line).

The downmix selection examples illustrated in FIGS. 4*a* to 4*f* are nonlimiting. Other combinations or applications of criteria can be envisaged.

For example, a cross fading could be applied in the embodiment where the criterion is the indicator ISD.

A downmix combining 3 types of downmix with adaptive weightings, of type $M[k]=p1 \cdot M_1[k]+p2 \cdot M_2[k]+p3 \cdot M_3[k]$ could also be chosen. The weightings p1, p2 and p3 then being adapted according to the selection criteria.

Figure 5:
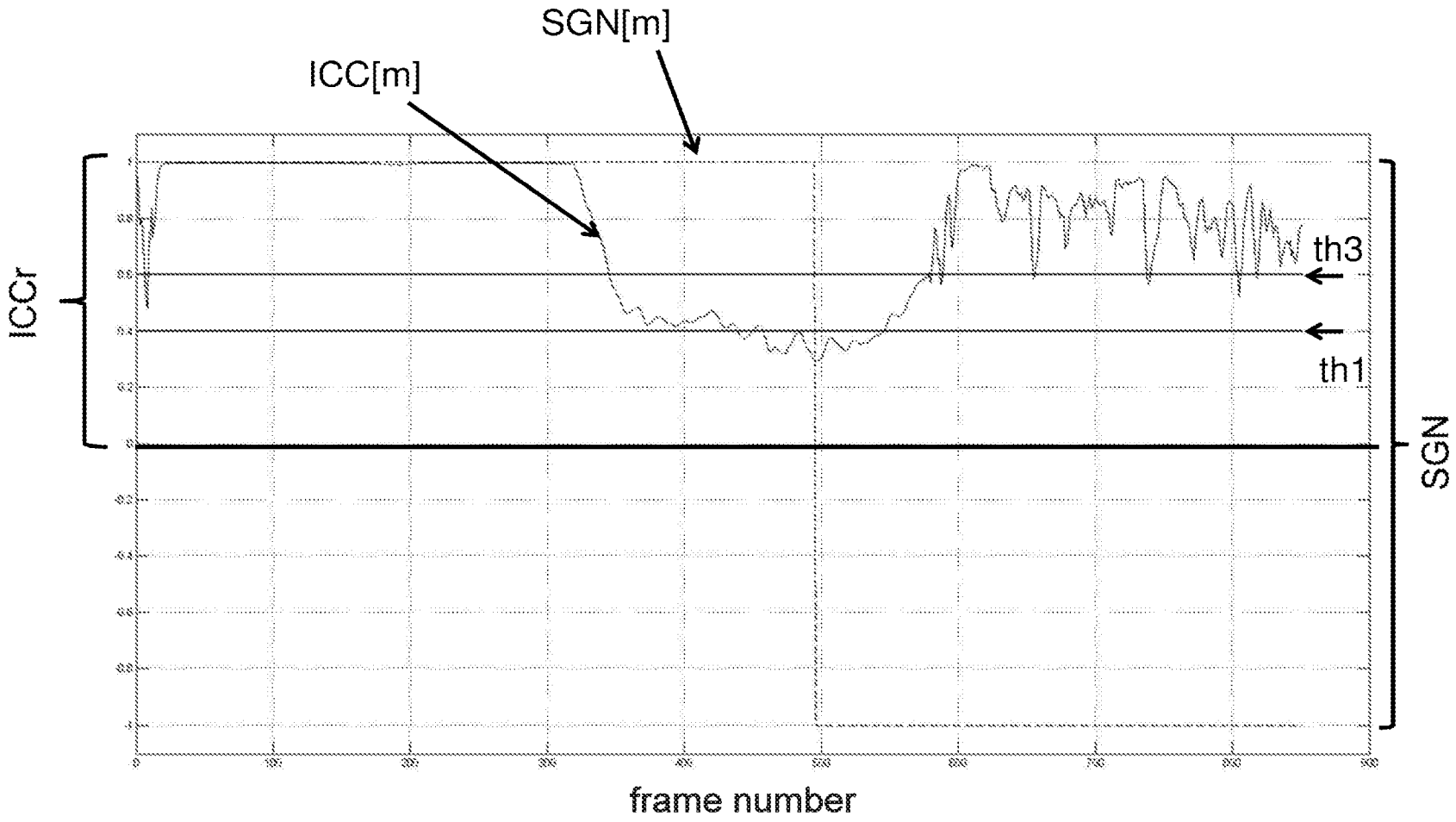
FIG. 5 illustrates an example of a trend of an indicator characterizing the channels of a given multi-channel signal used according to an embodiment of the invention, for a given signal.

FIG. 5 gives an example of trend of the parameter ICCr for a given signal with the decision thresholds th3 and th1 set at 0.4 and 0.6 as described in the exemplary embodiment of FIG. 4*b*. It will be noted that these predetermined values are above all valid for a 20 ms frame and they will be able to be modified if the frame length is different.

This figure shows the fluctuation of this indicator ICCr and of the indicator SGN. It is therefore true to practice to best adapt the downmix processing as a function of the trend of this indicator. In effect, a significant correlation of the signals for the frames from 100 to 300, for example, can allow an adaptive downmix with alignment on a phase reference. When the indicator ICCr is located between the thresholds th1 and th3, that means that the channels of the signal are moderately correlated and that they are potentially in phase opposition. In this case, the downmix to be applied depends on an indicator revealing a phase opposition between the channels. If the indicator reveals a phase opposition, then it is preferable to select the downmix with alignment on an adaptive phase reference defined hereinabove by $M_3[k]$. Otherwise, the passive downmix with gain compensation defined hereinabove by $M_1[k]$ is sufficient.

The value of the parameter SGN which is also represented in FIG. 5 is used to choose the correct phase reference in the case where the correlation indicator is below a threshold, for example 0.4. In the example of FIG. 5, the phase reference therefore switches from L to R in the vicinity of the frame 500.

Now return to FIG. 3. To adapt the spacialization parameters to the mono signal as obtained by the downmix processings described above, a particular extraction of the parameters by the block 314 is now described.

To adapt the spacialization parameters to the mono signal as obtained by the downmix processing described above, a particular extraction of the parameters by the block 314 is now described with reference to FIG. 3.

For the extraction of the parameters ICLD (block 314), the spectra $L_{buf}[k]$ and $R_{buf}[k]$ are sub-divided into frequency sub-bands. These sub-bands are defined by the following boundaries:

$K_{b=0.35}$=[1 2 3 4 6 7 9 11 13 15 18 21 24 28 32 36 41 47 53 59 67 75 84 94 105 118 131 146 163 182 202 225 250 278 308 321]

The above array delimits (in terms of number of Fourier co-efficients) the frequency sub-bands of index b=0 to 34. For example, the first sub-band (b=0) goes from the co-efficient $k_b$=0 to $k_{b+1}$−1=0; it is therefore reduced to a single co-efficient which represents 25 Hz. Likewise, the last sub-band (k=34) goes from the co-efficient $k_b$=308 to $k_{b+1}$−1=320, it comprises 12 co-efficients (300 Hz). The frequency line of index k=321 which corresponds to the Nyquist frequency is not taken into account here.

For each frame, the ICLD of the sub-band b=0 . . . 34 is computed according to the equation:

$$ICLD[b] = 10 \cdot \log_{10}\left\{\frac{\sigma_L^2[b]}{\sigma_R^2[b]}\right\} \tag{21}$$

where $\sigma_L^2[b]$ and $\sigma_R^2[b]$ respectively represent the energy of the left channel ($L_{buf}[k]$) and of the right channel ($R_{buf}[k]$):

$$\begin{cases} \sigma_L^2[b] = \sum_{k=k_b}^{k_{b+1}-1} L[k] \cdot L^*[k] \\ \sigma_R^2[b] = \sum_{k=k_b}^{k_{b+1}-1} R[k] \cdot R^*[k] \end{cases} \tag{22}$$

According to a particular embodiment, the parameters ICLD are coded by a differential non-uniform scalar quantization (block 315). This quantization will not be detailed here because it goes beyond the scope of the invention.

Similarly, the parameters ICPD and ICC are coded by methods known to the person skilled in the art, for example with a uniform scalar quantization over the appropriate interval.

Figure 7:
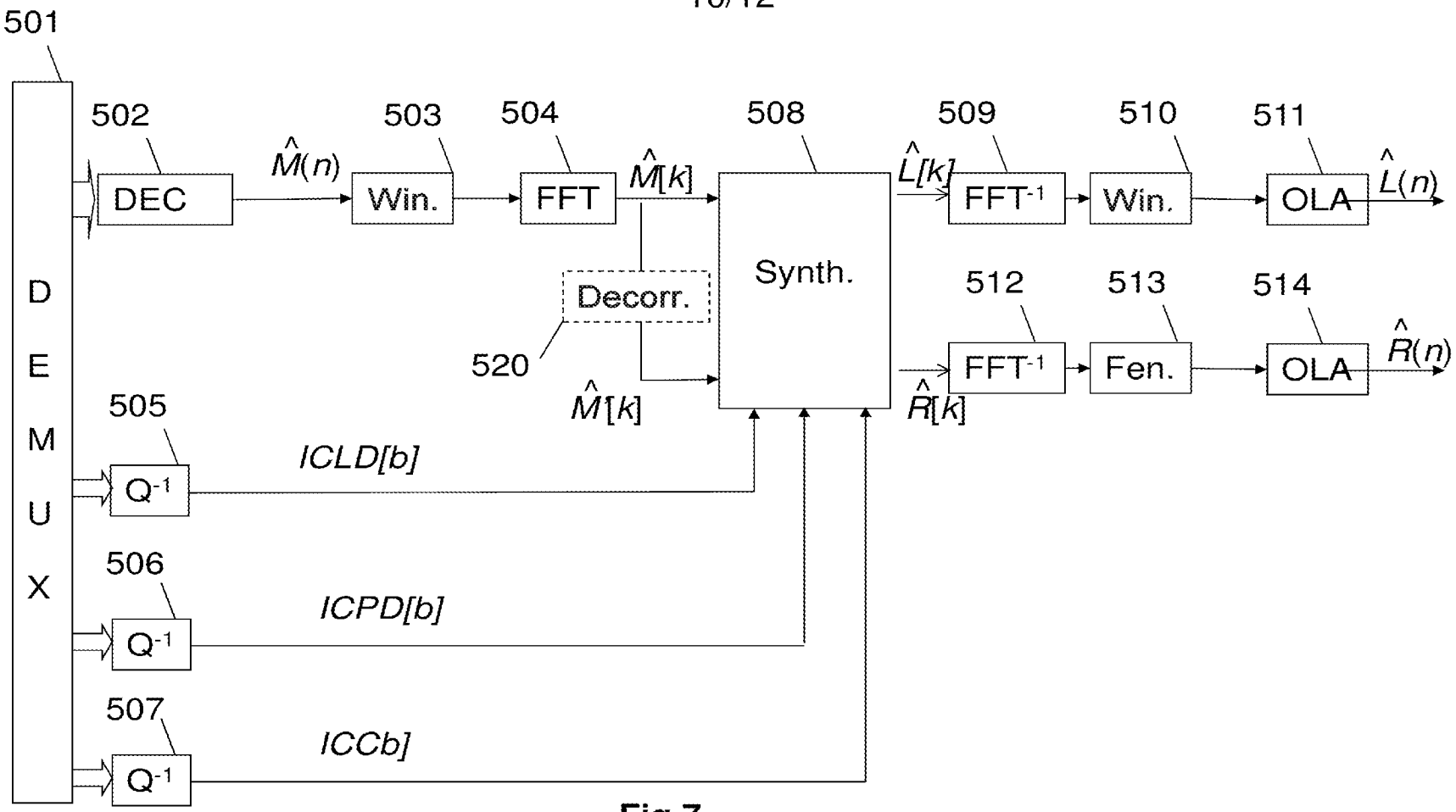
FIG. 7 illustrates a stereo parametric decoder implementing a decoding adapted to the signals coded according to the coding method of the invention.

Referring to FIG. 7, a decoder according to an embodiment of the invention is now described.

This decoder comprises a demultiplexer 501 in which the coded mono signal is extracted to be decoded in 502 by a mono EVS decoder in this example. The part of the bit stream corresponding to the mono EVS coder is decoded according to the bit rate used on the coder. It is assumed here that there are no frames lost nor binary errors on the bit stream to simplify the description, but known frame loss correction techniques can obviously be implemented in the decoder.

The decoded mono signal corresponds to $\hat{M}(n)$ in the absence of channel errors. An analysis by short-term discrete Fourier transform with the same windowing as in the coder is performed on $\hat{M}(n)$ (blocks 503 and 504) to obtain the spectrum $\hat{M}[k]$. It is considered here that a decorrelation in the frequency domain (block 520) is also applied.

The part of the bit stream associated with the stereo extension is also demultiplexed. The parameters ICLD, ICPD, ICC are decoded to obtain $ICLD^q[b]$, $ICPD^q[b]$ and $ICC^2[b]$ (blocks 505 to 507). Furthermore, the decoded mono signal will be able to be decorrelated for example in the frequency domain (block 520). The details of implementation of the block 508 are not presented here because they go beyond the scope of the invention, but the conventional techniques known to the person skilled in the art will be able to be used.

The spectra $\hat{L}[k]$ and $\hat{R}[k]$ are thus computed and then converted into the time domain by inverse FFT, windowing, addition and overlap (blocks 509 to 514) to obtain the synthesized channels $\hat{L}(n)$ and $\hat{R}(n)$.

The coder presented with reference to FIG. 3 and the decoder presented with reference to FIG. 7 have been described in the particular stereo coding and decoding application case. The invention has been described from a decomposition of the stereo channels by discrete Fourier transform. The invention applies also to other complex representations, such as, for example, the MCLT (Modulated Complex Lapped Transform) decomposition combining a modified discrete cosine transform (MDCT) and modified discrete sine transform (MDST), as well as to the case of banks of filters of pseudo-quadrature filter (PQMF) type. Thus, the term "frequency co-efficient" used in the detailed description can be extended to the concept of "sub-band" or of "frequency band", without altering the nature of the invention.

Finally, the downmix that is the subject of the invention will be able to be used not only in the coding but also in the decoding in order to generate a mono signal at the output of a stereo decoder or receiver, in order to ensure a compatibility with purely mono equipment. That may be the case for example when switching from a sound reproduction on a headset to a loudspeaker reproduction.

Figure 8:
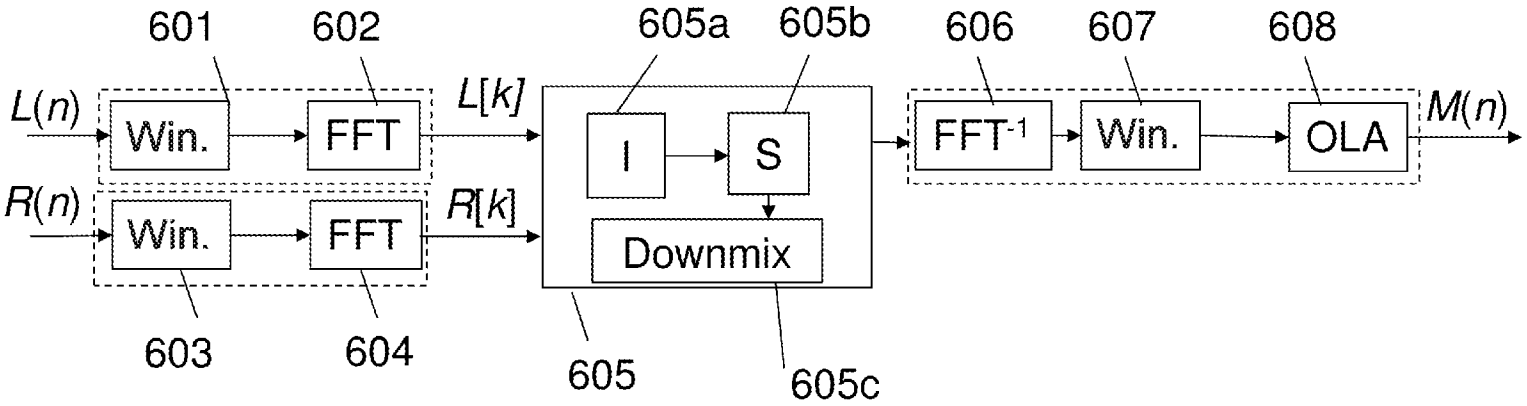
FIG. 8 illustrates a device for processing a decoded audio signal in which a downmix processing according to the invention is performed.

FIG. 8 illustrates this embodiment. A stereo signal, for example, is received decoded (L(n), R(n)). It is transformed by the respective blocks 601, 602, and 603, 604 to obtain the left and right spectra (L[k] and R[k]).

One of the methods as described with reference to FIGS. 4*a* to 4*f* is then implemented in the processing block 605, in the same way as for the processing block 307 of FIG. 3.

This processing block 605 comprises a module 605*a* for obtaining at least one indicator characterizing the channels of the multi-channel stereo signal received, here the stereo signal. The indicator can for example be an indicator of inter-channel correlation type or an indicator of measurement of degree of phase opposition between channels.

Based on the value of this indicator, the selection block 605*b* selects, from a set of downmix processing modes, a downmix processing mode which is applied in 605*c* to the input signals, here to the stereo signal L[k], R[k] to give a mono signal M[k].

The coders and decoders as described with reference to FIGS. 3, 7 and 8 can be incorporated in multimedia equipment of room decoder, or set top box, or audio or video content reader type. They can also be incorporated in communication equipment of cell phone or communication gate way type.

In variants, the case of a downmix from 5.1 channels to a stereo signal is considered. Instead of 2 channels at the downmix input, the case is considered of a surround signal of 5.1 type defined as a set of 6 channels: L (front left), C (center), R (front right), Ls (left surround or rear left), Rs (right surround or rear right), LFE (low frequency effects or sub-woofer). In this case, two variants of downmix from 5.1 stereo can be applied according to the invention:

The C and LFE channels can be combined by passive downmix and the result can be combined separately with the L and R channels by applying the embodiments of downmix from two channels (stereo) to one channel (mono) to respectively obtain L' and R' channels. Then, the L' and R' channels can also be combined respectively with Ls and Rs by applying the embodiments of downmix from two channels (stereo) to one channel (mono) to respectively obtain L" and R" channels which constitute the result of the downmix.

This implementation therefore "hierarchically" (by successive steps) involves an elementary downmix of 2-to-1 type described previously according to different variants.

In a more general variant, the invention will be able to be generalized to simultaneously combine 3 channels on one side L, Ls, C+LFE and, on another side, R, Rs, C+LFE where C+LFE is the result of a simple passive downmix to directly obtain two channels L" and R".

In this case, it will be possible to define several downmixes as in the stereo case: a passive downmix $M_1[k]$ of the 3 signals with gain compensation, a downmix $M_3[k]$ of the 3 signals with adaptive alignment of the phase on an adaptive reference (the dominant signal of the 3). In this case, the downmix is obtained according to the generalization:

$$M[k]=p1(\mathrm{ICC}r12,\mathrm{ICC}r13,\mathrm{ICC}r23),M_1[k]+p3(\mathrm{ICC}r12,\mathrm{ICC}r13,\mathrm{ICC}r23),M_3[k]$$

where the weightings p1 and p3 are functions with several variables, for example the correlation ICCrij between each pair of respective channels i and j (for example, L, Ls, C+LFE) taken two-by-two.

In other variants of the invention, the number of channels at the input and at the output of the downmix will be able to be different from the stereo-to-mono or 5.1-to-stereo cases illustrated here.

Figure 9:
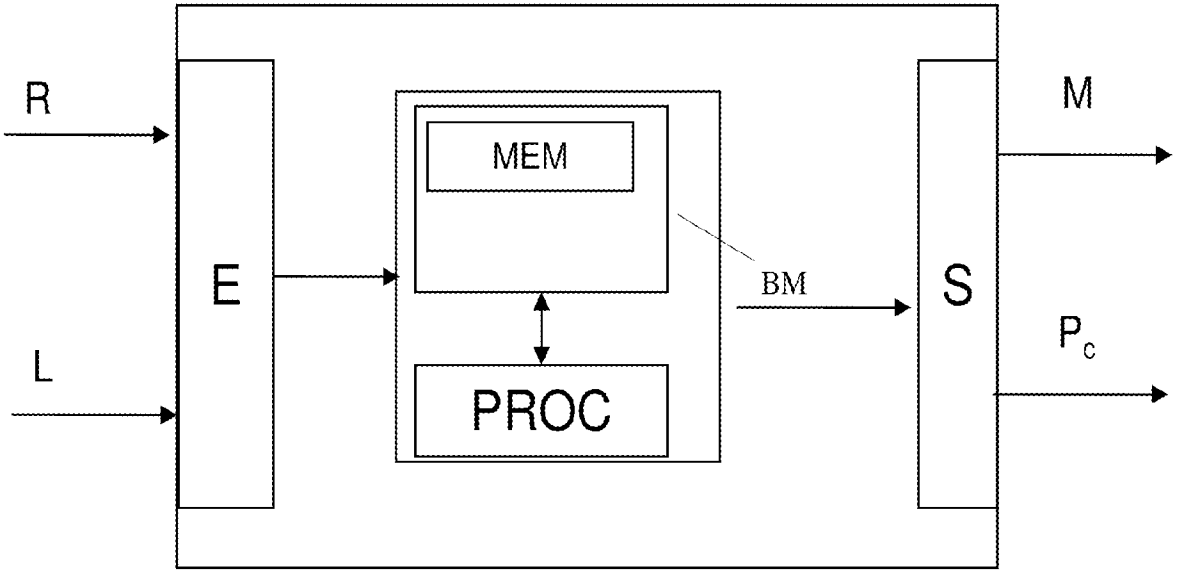
FIG. 9 illustrates a hardware example of an equipment item incorporating a coder capable of implementing the coding method, according to an embodiment of the invention.

FIG. 9 represents an exemplary embodiment of such an equipment item in which a coder as described with reference to FIG. 3 or a processing device as described with reference to FIG. 8 according to the invention is incorporated. This device comprises a processor PROC co-operating with a memory block BM comprising a storage and/or working memory MEM.

The memory block can advantageously comprise a computer program comprising code instructions for the implementation of the steps of the coding method within the meaning of the invention, or of the processing method when these instructions are executed by the processor PROC, and in particular the steps of extraction of at least one indicator characterizing the channels of the multi-channel digital audio signal and of selecting, from a set of downmix processing modes, a downmix processing mode as a function of the value of the at least one indicator characterizing the channels of the multi-channel audio signal.

These instructions are executed for a downmix processing during a coding of a multi-channel signal or a processing of a decoded multi-channel signal.

The program can comprise the steps implemented to code the information adapted to this processing.

The memory MEM can store the different downmix processing modes to be selected according to the method of the invention.

Typically, the descriptions of FIGS. 3, 4*a* to 4*f* represent the steps of an algorithm of such a computer program. The computer program can also be stored on a memory medium that can be read by a reader of the device or equipment item or that can be downloaded into the memory space thereof.

Such an equipment item or coder comprises an input module capable of receiving a multi-channel signal, for example a stereo signal comprising the channels R and L for right and left, either via a communication network, or by reading a content stored on a storage medium. This multimedia equipment item can also comprise means for capturing such a stereo signal.

The device comprises an output module capable of transmitting a mono signal M derived from the downmix processing selected according to the invention and, in the case of a coding device, the coded spatial information parameters $P_c$.

Although the present disclosure has been described with reference to one or more examples, workers skilled in the art will recognize that changes may be made in form and detail without departing from the scope of the disclosure and/or the appended claims.

The invention claimed is:

1. A method comprising the following acts performed by a parametric coding device:

downmix processing applied to a multi-channel digital audio signal; and parametric coding of the multi-channel digital audio signal, comprising coding a mono signal derived from the downmix processing applied to the multi-channel digital audio signal and coding multi-channel digital audio signal spatialization information, wherein the downmix processing comprises the following acts, implemented for each spectral unit of the multi-channel digital audio signal:

extraction of at least one indicator characterizing the channels of the multi-channel digital audio signal; and selection, from a set of downmix processing modes, of a downmix processing mode as a function of the value of the at least one indicator characterizing the channels of the multi-channel digital audio signal.

2. The method as claimed in claim 1, further comprising determining a phase indicator, representative of a measurement of degree of phase opposition between the channels of the multi-channel digital audio signal and in that one of the downmix processing modes of said set depends on the value of the phase indicator.

3. The method as claimed in claim 1, wherein the set of downmix processing modes comprises a plurality of processing modes from the following list:

passive-type downmix processing with or without gain compensation;

adaptive-type downmix processing with alignment of the phase on a reference and/or energy control;

hybrid-type downmix processing dependent on a phase indicator, representative of a measurement of degree of phase opposition between the channels of the multi-channel digital audio signal;

combination of at least two passive, adaptive or hybrid processing modes.

4. The method as claimed in claim 1, wherein the indicator characterizing the channels of the multi-channel digital audio signal is an indicator of measurement of correlation between the channels of the multi-channel digital audio signal.

5. The method as claimed in claim 1, wherein the indicator characterizing the channels of the multi-channel digital audio signal is a phase indicator, representative of a measurement of degree of phase opposition between the channels of the multi-channel digital audio signal.

6. A device comprising:

a downmix processing module, which applies downmix processing to a multi-channel digital audio signal;

a coder, which applies a parametric coding to the multi-channel digital audio signal, including coding a mono signal derived from the downmix processing module; and a quantization module, which codes multi-channel digital audio signal spatialization information, wherein the downmix processing module comprises:

an extraction module, which obtains at least one indicator characterizing the channels of the multi-channel digital audio signal, for each spectral unit of the multi-channel digital audio signal;

a selection module, which selects, for each spectral unit of the multi-channel digital audio signal, from a set of downmix processing modes, a downmix processing mode as a function of the value of the at least one indicator characterizing the channels of the multi-channel digital audio signal, wherein the downmix processing module is implemented at least in part by a processor and instructions stored in a non-transitory computer-readable medium and executable by the processor.

7. A method comprising the following acts performed by a processing device:

processing a decoded multi-channel digital audio signal comprising a downmix processing to obtain a mono signal to be reproduced, wherein the downmix processing comprises the following acts, implemented for each spectral unit of the decoded multi-channel digital audio signal:

extraction of at least one indicator characterizing the channels of the decoded multi-channel digital audio signal; and selection, from a set of downmix processing modes, of a downmix processing mode as a function of the value of the at least one indicator characterizing the channels of the decoded multi-channel digital audio signal.

8. A device comprising:

a downmix processing module, which processes a decoded multi-channel digital audio signal to obtain a mono signal to be reproduced, wherein the downmix processing module comprises:

an extraction module configured to obtain at least one indicator characterizing the channels of the multi-channel digital audio signal, for each spectral unit of the decoded multi-channel digital audio signal; and a selection module, configured to select, for each spectral unit of the decoded multi-channel digital audio signal, from a set of downmix processing modes, a downmix processing mode as a function of the value of the at least one indicator characterizing the channels of the decoded multi-channel digital audio signal, wherein the downmix processing module is implemented at least in part by a processor and instructions stored in a non-transitory computer-readable medium and executable by the processor.

9. A non-transitory processor-readable medium comprising instructions stored thereon, which when executed by a processor configure the processor to perform acts comprising:

downmix processing applied to a multi-channel digital audio signal; and parametric coding of the multi-channel digital audio signal, comprising coding a mono signal derived from the downmix processing applied to the multi-channel digital audio signal and coding multi-channel digital audio signal spatialization information, wherein the downmix processing comprises the following acts, implemented for each spectral unit of the multi-channel digital audio signal:

extraction of at least one indicator characterizing the channels of the multi-channel digital audio signal; and selection, from a set of downmix processing modes, of a downmix processing mode as a function of the value of the at least one indicator characterizing the channels of the multi-channel digital audio signal.

* * * * *